US010219621B2

(12) United States Patent
Wilhelmsen

(10) Patent No.: US 10,219,621 B2
(45) Date of Patent: Mar. 5, 2019

(54) NESTING TRANSPORTABLE WINE BARREL RACK

(71) Applicant: Dennis Brian Wilhelmsen, Rohnert Park, CA (US)

(72) Inventor: Dennis Brian Wilhelmsen, Rohnert Park, CA (US)

(73) Assignee: WILHELMSEN INDUSTRIES, LLC, Cotati, CA (US)

( * ) Notice: Subject to any disclaimer, the term of this patent is extended or adjusted under 35 U.S.C. 154(b) by 0 days.

(21) Appl. No.: 15/360,924

(22) Filed: Nov. 23, 2016

(65) Prior Publication Data

US 2017/0071336 A1 Mar. 16, 2017

Related U.S. Application Data

(63) Continuation-in-part of application No. 14/920,726, filed on Oct. 22, 2015.

(60) Provisional application No. 62/184,711, filed on Jun. 25, 2015, provisional application No. 62/067,390, filed on Oct. 22, 2014.

(51) Int. Cl.

| | |
|---|---|
| ***A47B 81/00*** | (2006.01) |
| ***B65D 19/12*** | (2006.01) |
| ***B65D 19/38*** | (2006.01) |

(52) U.S. Cl.

CPC ..... *A47B 81/007* (2013.01); *B65D 19/12* (2013.01); *B65D 19/385* (2013.01); *B65D 2519/0098* (2013.01); *B65D 2519/00164* (2013.01); *B65D 2519/00572* (2013.01); *B65D 2519/00796* (2013.01); *B65D 2519/00815* (2013.01); *B65D 2519/00965* (2013.01)

(58) Field of Classification Search

CPC ..... B65D 19/12; B65D 19/385; B65D 19/44; B65D 71/70; B65D 85/20; B65D 85/66; B65D 2519/00796; B65D 2519/00572; B65D 2519/00815; B65D 2519/0098; B65D 2519/00164; B65D 2519/00965; A47B 81/007

USPC ..... 211/85.22, 59.4

See application file for complete search history.

(56) References Cited

U.S. PATENT DOCUMENTS 487,765 A * 12/1892 Ormerod ..... A47B 81/007 211/85.22

2,846,078 A * 8/1958 Shelby ..... A47B 81/007 211/85

3,019,916 A * 2/1962 Malcher ..... B65D 19/44 108/53.1

(Continued)

*Primary Examiner* — Patrick D Hawn

(74) *Attorney, Agent, or Firm* — Mintz Levin Cohn Ferris Glovsky and Popeo, P.C.

(57) ABSTRACT

A wine barrel rack system having first and second ground level side rails oriented generally parallel to one another, each of the first and second ground level side rails fabricated from sheet metal panels, and having an upper bend forming a flange and a lower bend forming a flange, and having a plurality of upper arcuate cut outs shaped and sized for cradling a wine barrel. Connecting members join the rails to form the rack, which may have ground level configuration and an upper, stackable configuration, the latter including either elongate rails with cutouts for mounting on lower barrels and support upper barrels, or discrete arcuate barrel cradles for mounting between two lower barrels and support a single barrel.

12 Claims, 23 Drawing Sheets

(56) References Cited

U.S. PATENT DOCUMENTS 3,368,690 A * 2/1968 Konstant ..... A47B 81/007 211/85.22
3,476,260 A * 11/1969 Jay ..... A47B 81/007 108/53.1
3,590,752 A * 7/1971 De Pew ..... B65D 19/44 108/53.5
3,753,407 A * 8/1973 Tilseth ..... B65D 19/44 108/53.3
3,887,078 A * 6/1975 Jay ..... B65G 1/0442 211/50
3,912,083 A * 10/1975 Jay ..... B65G 1/0442 211/50
4,093,076 A * 6/1978 Newton ..... A47B 73/006 211/189
4,431,107 A * 2/1984 Bergstrom ..... A47B 81/007 211/189
4,488,649 A * 12/1984 Mark ..... A47B 81/007 206/391
4,506,796 A * 3/1985 Thompson ..... A47B 81/007 108/55.3
4,901,870 A * 2/1990 Wright ..... B65D 85/20 206/446
5,161,703 A * 11/1992 Patton ..... A47F 7/281 206/446
5,370,245 A * 12/1994 Tersch ..... A47B 73/006 211/194
5,755,541 A * 5/1998 Suarez ..... B60P 7/12 211/59.4
5,984,119 A * 11/1999 Uhl ..... B65D 71/70 211/59.4
6,050,538 A * 4/2000 Marrow ..... B65D 71/70 248/154
D466,269 S * 11/2002 Falland ..... D34/38
6,502,696 B2 * 1/2003 Heinrichs ..... F42B 39/00 108/55.3
6,997,330 B2 * 2/2006 Pachao-Morbitzer ..... B65D 71/0092 206/391
7,448,505 B2 * 11/2008 DeMent ..... B60P 7/12 211/59.4
7,458,553 B2 * 12/2008 Tzur ..... B65D 19/44 248/346.02
7,494,308 B2 * 2/2009 Chun ..... B60T 17/06 410/47
7,708,155 B2 * 5/2010 DeMent ..... B60P 7/12 211/59.4
D628,353 S * 11/2010 Garton ..... D34/38
D628,354 S * 11/2010 Garton ..... D34/38
8,118,180 B2 * 2/2012 Van Belkom ..... A47B 81/007 211/120
2002/0036178 A1 * 3/2002 Tombu ..... B65G 1/02 211/74
2004/0026346 A1 * 2/2004 Kelly ..... A47B 87/0207 211/74
2006/0081549 A1 * 4/2006 Gracia Lecina ..... B65G 1/14 211/85.22
2012/0318763 A1 * 12/2012 Garton ..... B62B 3/16 211/85.22
2013/0001179 A1 * 1/2013 Harpole ..... B65D 19/12 211/59.4
2016/0058182 A1 * 3/2016 Langston ..... A47B 47/0091 211/85.22

* cited by examiner 400
442
444
446

406
414
416
418

NESTING TRANSPORTABLE WINE BARREL RACK

CROSS REFERENCES TO RELATED APPLICATIONS

The present application claims the benefit of the filing date of U.S. patent application Ser. No. 14/920,726, filed Oct. 22, 2015 (Oct. 22, 2015), which claims the benefit of U.S. Provisional Patent Application Ser. No. 62/184,711, filed Jun. 25, 2015 (Jun. 25, 2015) and U.S. Provisional Patent Application Ser. No. 62/067,390, filed Oct. 22, 2014 (Oct. 22, 2014), all of which are incorporated in their entirety by reference herein.

TECHNICAL FIELD

The invention relates most generally to barrel racks, and more particularly to wine barrel racks, and still more particularly to a compact, nestable, and economically transportable wine barrel rack system having discrete barrel cradle assemblies for stacking either identically or differentially sized barrels in a staggered stacking configuration, while providing access to barrel bungs at all levels. In some stacking configurations, seismic stability can be enhanced with seismic straps.

BACKGROUND ART

In wine production, when fermentation has been completed and after large solids have been removed by racking, the young wine usually needs time for the acids, alcohol, tannins, and glycerin to knit together, to harmonize. Accordingly, it is a traditional practice to barrel age and store the wine for a period of time. This can be accomplished using a number of different kinds of vessels or containers, such as stainless steel tanks, cement vats, glass carboys, or, in most instances, wood barrels. The traditional wood barrel material is oak (indeed, nearly all fine wines, almost without exception, are aged in oak) because it adds depth and complexity by adding phenols and oak tannins to the wine, and thereby adds new bouquet and flavor dimensions. Aging in oak also softens grape tannins, increases volatile acidity and total acidity, and lowers pH. Stored the right amount of time, wine aged in oak barrels is generally considered to be improved.

In consequence, large scale producers often keep hundreds to many tens of thousands of barrels in storage in production and storage facilities, generally either in barrel rooms or wine caves. The racks, however, cover a considerable amount of floor space. Furthermore, they are generally assembled by welding square steel tubing with steel bars to make unitary, assembled, rigid and fixed racks of the kind taught by Ray, U.S. Pat. No. 3,476,260, which shows a wine rack design that dominates the industry at present. See, for instance, the various models offered at the website links by the following major current-day manufacturers:

http://www.topcoproducts.com/ http://www.westernsquare.com/breweries_and_distilleries/brewery_barrel_racks.html http://shop.carolinawinesupply.com/wine-barrel-racks_c34.htm http://barrelsandracks.com/racks/ http://www.rmswinebarrelracks.com/wine-barrel-racks/ http://barrel-racks.com/?page_id=18 http://shop.carolinawinesupply.com/Wine-Barrel-Racks_c34.htm http://barrelsandracks.com/racks/

From these, it will be seen that the rack dominant in the industry is a rigid square steel tube welded structure based on structural chocks welded onto square tube steel frame structure. The tube members are all welded together, and the bent steel bars forming wedges that act as chock are welded onto the tubes. The smallest units for stacking systems generally hold two barrels and stack atop two barrels. Bottom units simply cradle two barrels on top. Even this smallest structure consumes considerable space when assembled and welded, and thus when shipped. And stacking for shipment simply means that a substantial portion of the shipping volume is occupied by empty space.

As the South Napa Earthquake of Aug. 24, 2014 revealed, when racks are severely damaged in earthquakes, they are not amenable to repair and generally must be replaced. Fabrication of the conventional and traditional racks is time consuming and shipments are expensive. High demand taxes the ability of manufacturers to meet winery schedules for the needed stackable, palletized and forklift compatible barrel racks. In the years immediately following the South Napa Earthquake, there were many shipments of replacement racks required to address the losses. Among other things, that earthquake highlighted the need for a more compact rack, easily manufactured, easily and economically transported, and also easily dismantled for removal and relocation.

SUMMARY OF THE INVENTION

The present invention solves several subsisting problems, including the foregoing problems, by providing a low cost, easily manufactured, easily transported, and easily on-site assembled barrel rack that includes nesting component parts that ship in compact packages.

The wine barrel rack of the present invention advantageously exploits known principles of strengthening thin sheet metal panels by introducing bends and cutouts in the panels. Thus, the barrel support function of what was previously provided by a very heavy and clumsy structure—rigid, unitary, preassembled square tubular steel wine barrel racks—can now be provided by extremely lightweight structural members that can be shipped as modular packages, easily handled, carried, and moved by individuals having unexceptional (entirely ordinary) strength.

In an embodiment, the disclosed wine barrel rack system includes first and second ground level side rails oriented generally parallel to one another. The side rails are joined to one another with either sheet metal panel connecting members or tubular metal connecting members, the latter having bolting plates or flanges disposed on their ends. The rack is assembled with nuts and bolts. Each of the side rails include an upper bend forming a flange and a lower bend forming a flange so as to enhance the strength of the panels. In an embodiment, barrel shaped cutouts are disposed on the upper edge of the side rails in a ground configuration of the rack, and on both upper and lower edges in an upper rack configuration. The cutouts may provide for barrel stacking in a generally stacked pattern, in which case upper cutouts in rails at upper levels are positioned generally directly above cutouts in the ground level rails and/or any other lower level of stacked barrels. They may also be configured for stacking in a staggered pattern.

In another embodiment, elongate tubular steel members span laterally between side rails and include bolting plates or flanges on each of their ends. The bolting plates are coupled to the side rails in an angled orientation to form a cradle.

Rubber support pads are slotted to fit over the bolting plate edges to cushion the cradle and distribute the barrel load. In this embodiment, barrels in upper rows may be supported by barrel-specific (discrete) arcuate cradles that may be coupled or linked with chain or cable. Seismic tie downs may be employed to connect to a frame disposed over barrel bung holes so as to keep wine stored in the barrels entirely accessible even in the seismically secure, stacked storage configurations.

BRIEF DESCRIPTION OF THE DRAWINGS

The invention will be better understood and objects and advantages other than those set forth above will become apparent when consideration is given to the following detailed description thereof. Such description makes reference to the annexed drawings, wherein.

DETAILED DESCRIPTION

Figure 1:
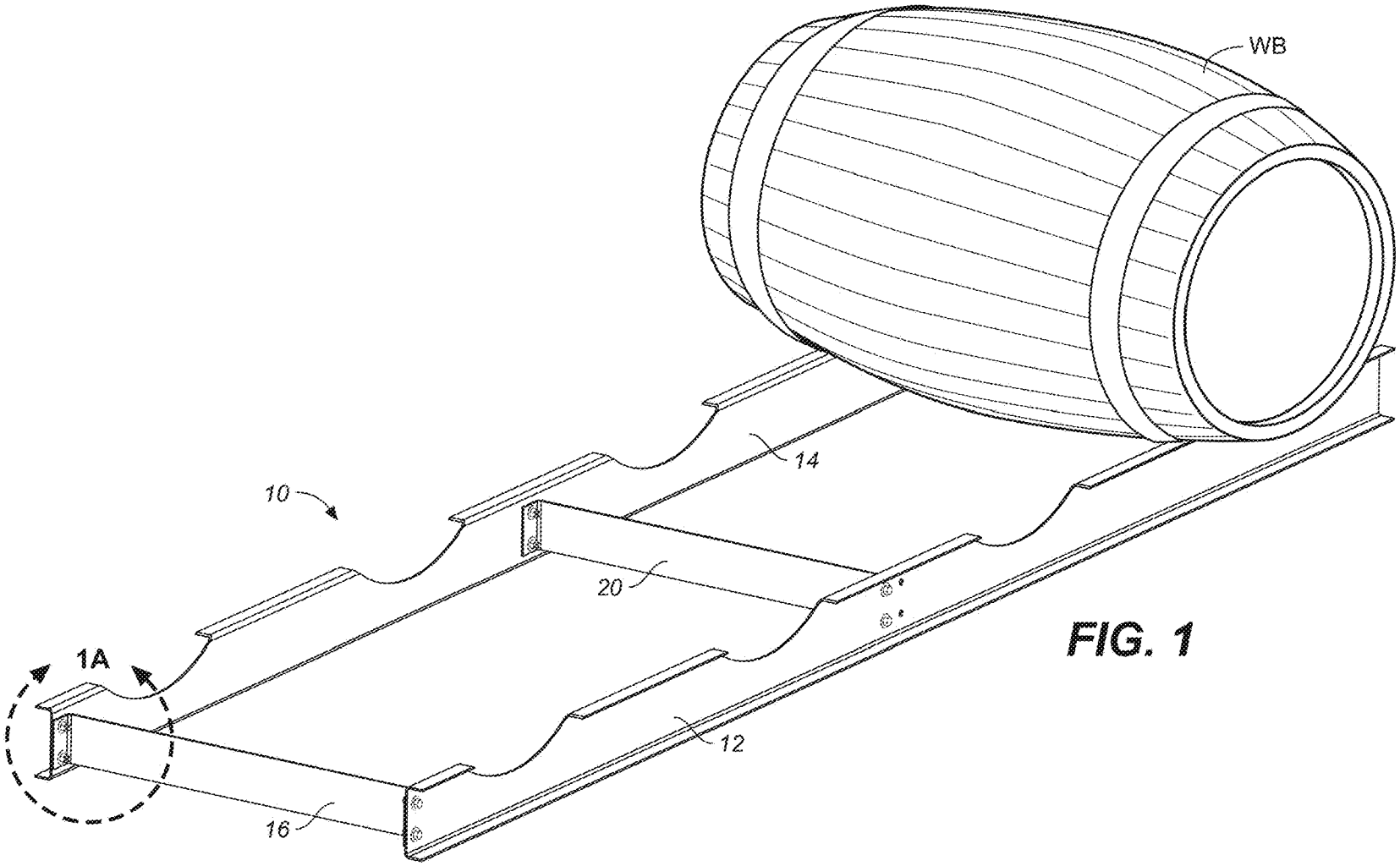
FIG. 1 is an upper front left perspective view of the ground level configuration of the wine barrel rack of an embodiment of the present invention, shown supporting a single wine barrel.

Referring first to FIGS. 1 through 14, wherein like reference numerals refer to like components in the various views, there is illustrated therein a new and improved nesting transportable wine barrel rack generally denominated 10 herein.

Looking now at FIG. 1, there is shown in perspective view the ground level configuration 10 of the barrel rack of the present invention, shown assembled and supporting a single barrel. The ground level of the rack includes a first side rail 12 and a second side rail 14 joined at their ends 12*a*/12*b* and 14*a*/14*b*, respectively, by first and second cross members, namely, connecting end panels 16, 18, as well as a medial cross member or connecting panel 20. The side rails are identical to one another, as are the connecting panels. Accordingly, in discussing these elements, attention is drawn to one as representative of the others.

Thus, it is seen that each ground level side rail 12/14 includes a plurality of upper arcuate cut outs 22, each suitable for supporting or cradling a wine barrel when paired with a cutout on the opposing side rail, as shown in FIG. 1.

Each side rail further includes an outwardly directed lower bend or flange 24, and an outwardly directed upper bend or flange 26, continuous but for interruptions at the upper arcuate cutouts, and thereby comprising a formed sheet.

The connecting panels 16/18/20 are each U-shaped with end legs 28 and through holes 30 that align with through holes 32 in the side rails for connection with nuts and bolts 34, 36, respectively. Washers 38 are preferably employed, for all the well-known reasons.

Figures 1A, 1B:
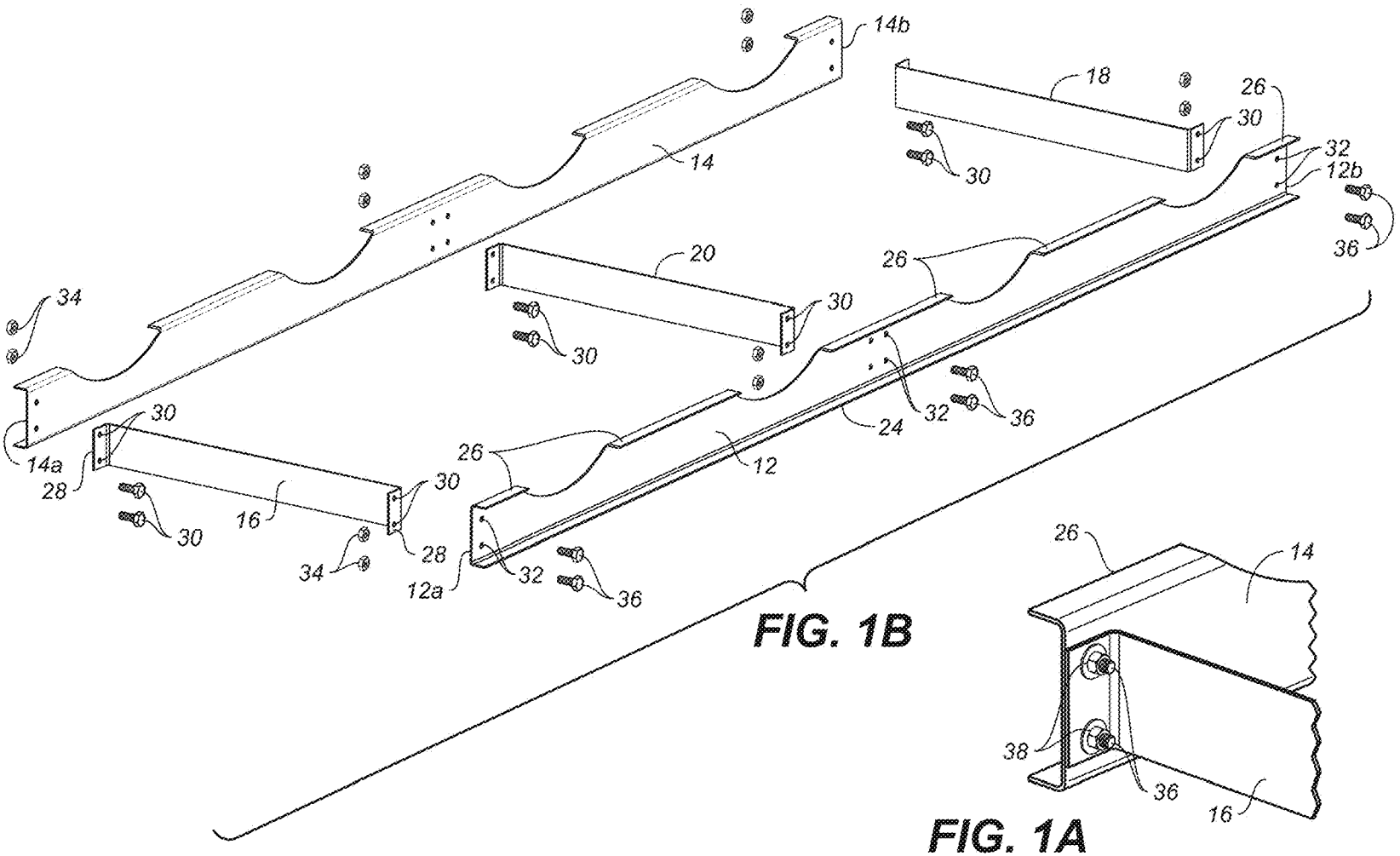
FIG. 1A is a detailed upper front left perspective view taken along cut line 1A of FIG. 1.
FIG. 1B is an exploded view of the apparatus of FIG. 1.
Figure 2A:
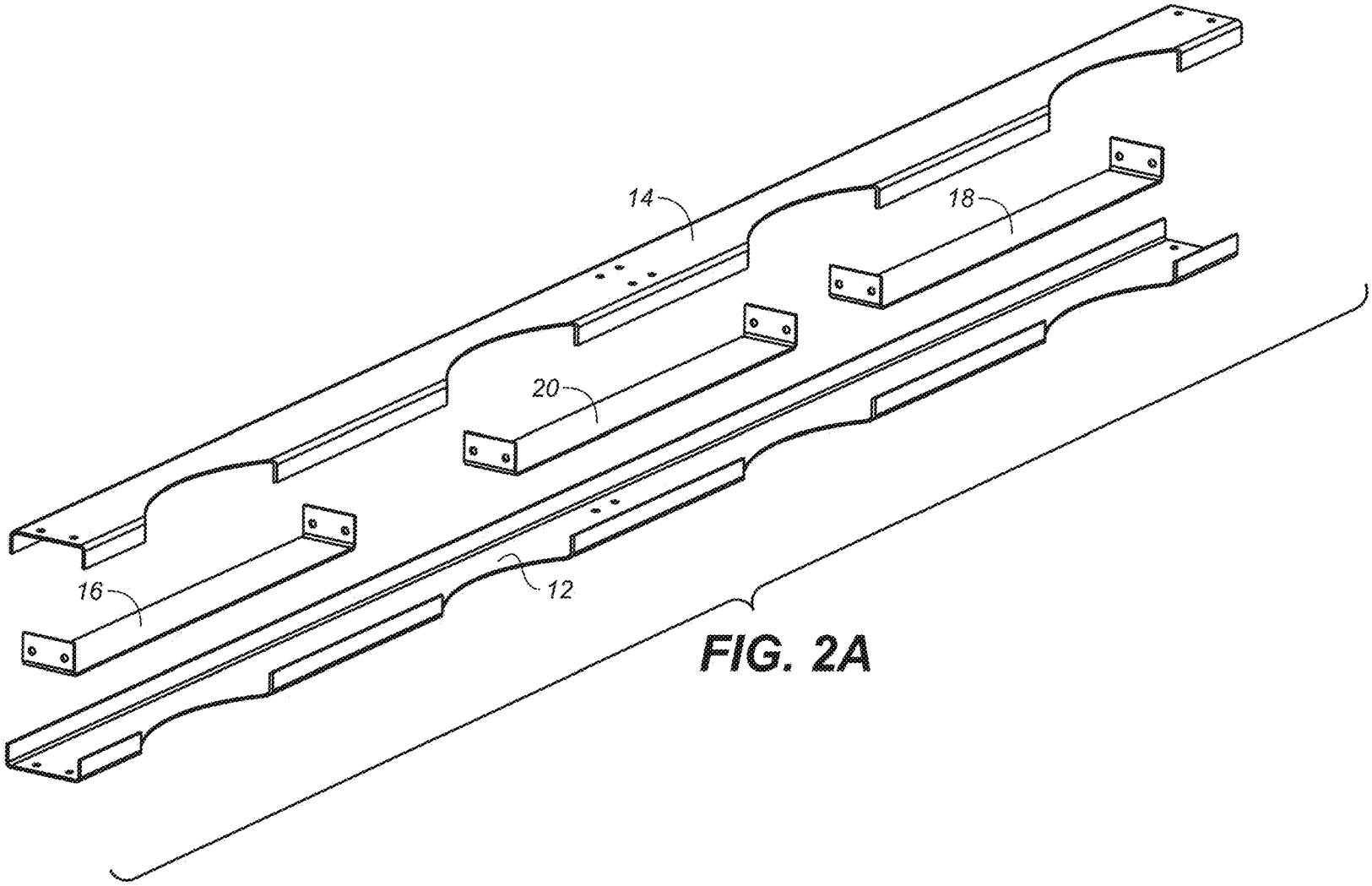
FIG. 2A is an upper left front perspective view showing the sheet metal side rails and connecting panels of an embodiment of the inventive rack, nuts and bolts removed, disassembled, and poised for compact packing for transport or storage.
Figure 2B:
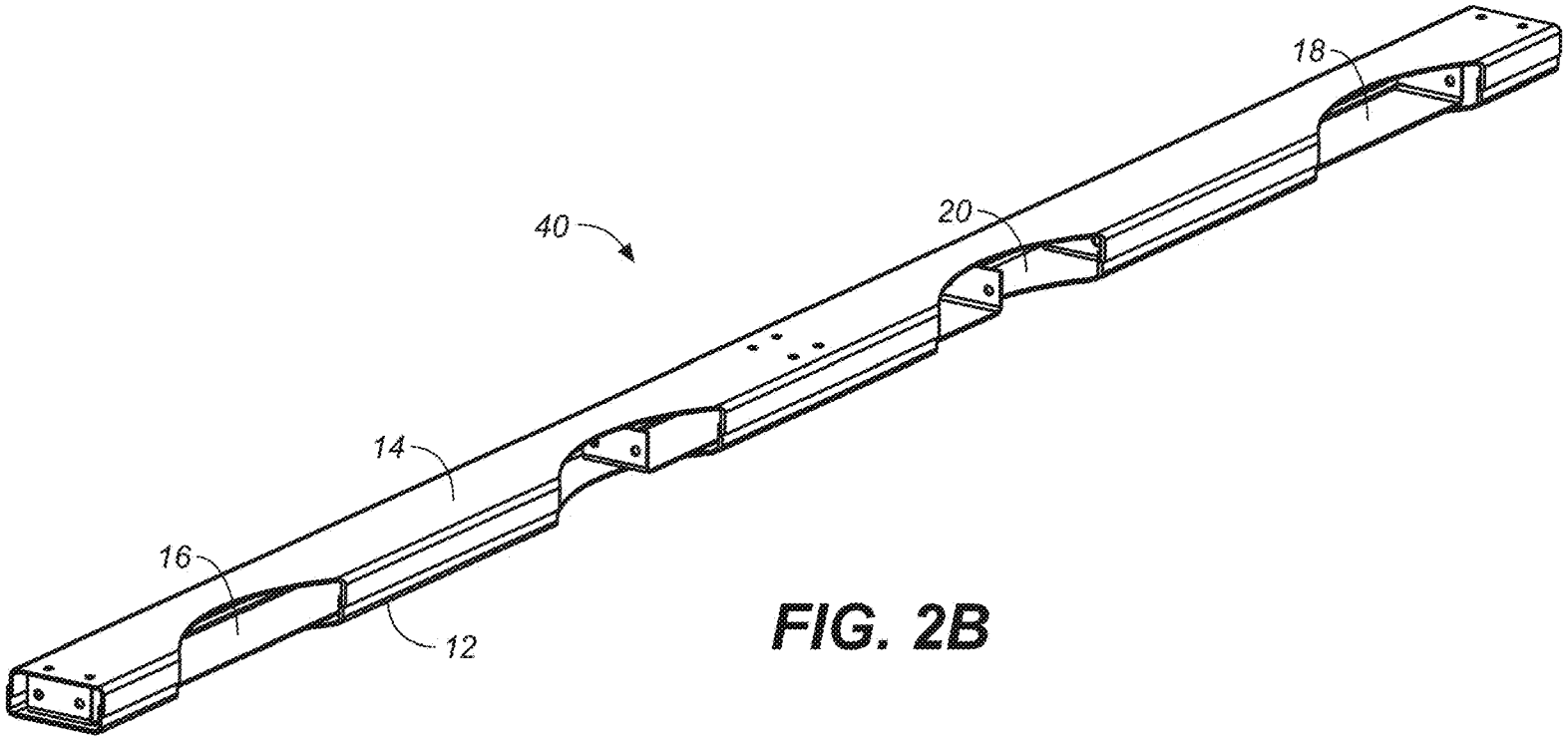
FIG. 2B is an upper front left perspective view showing the rack elements in a compact nested configuration.
Figure 3A:
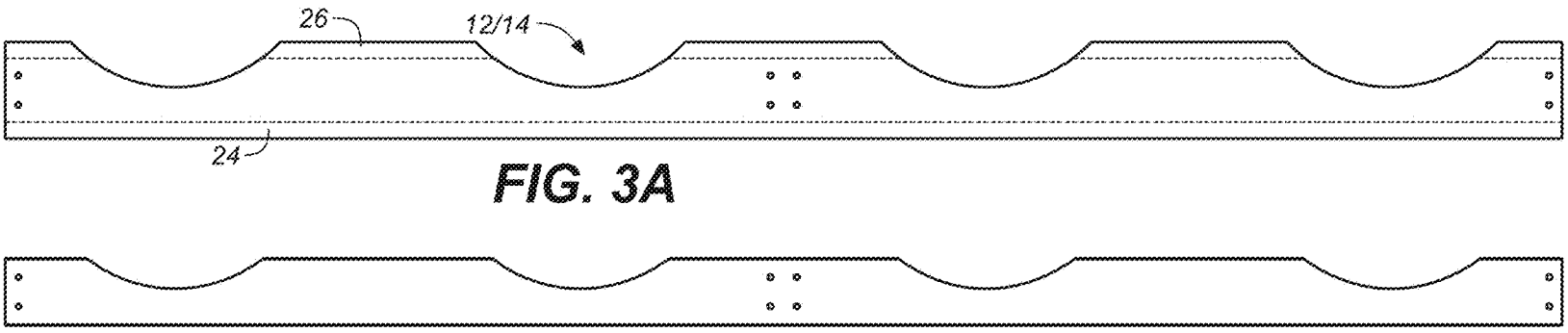
FIG. 3A is a side view in elevation showing a sheet metal side rail after cutting but before bending, wherein the bend lines are shown with dashes.
Figure 3B:
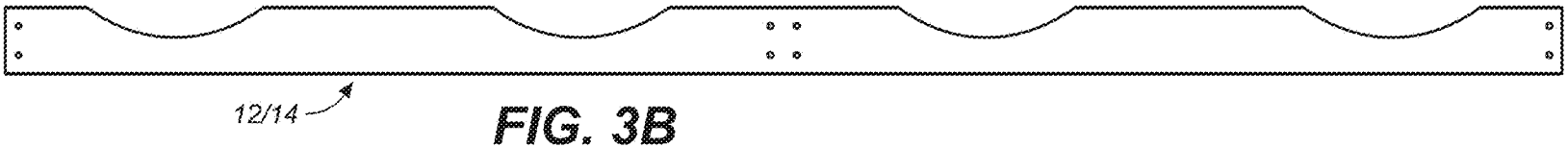
FIG. 3B is the same view showing the side rail after the upper and lower bends have been made.
Figure 3C:
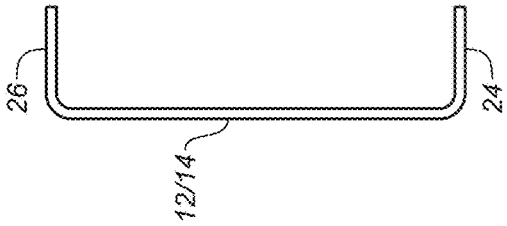
FIG. 3C is an end view in elevation of the side rails.

It will be noted, by reference to each of FIGS. 1-1B, that the connecting panels 16, 18, 20, are slightly less wide (i.e., have a lower profile) than the side rails 12, 14. Accordingly, and referring now to FIGS. 2A-2B, if the side rails are turned on their longitudinal (horizontal axis) such that the lower flange 26 and upper flange 26 are facing, they are positioned to couple around the connecting panels in a nested configuration 40 (FIG. 2B) for storage and transport.

The barrel rack system has distinct manufacturing advantages over the known art. This derives from the simplicity, rapidity, and economically advantageous method of manufacture. Because they are formed of sheet metal, and because the manufacturing process includes only a few quick fabrication steps, the barrel racks can be rapidly manufactured on demand, and therefore no appreciable inventory need be stored anywhere.

Figure 4:
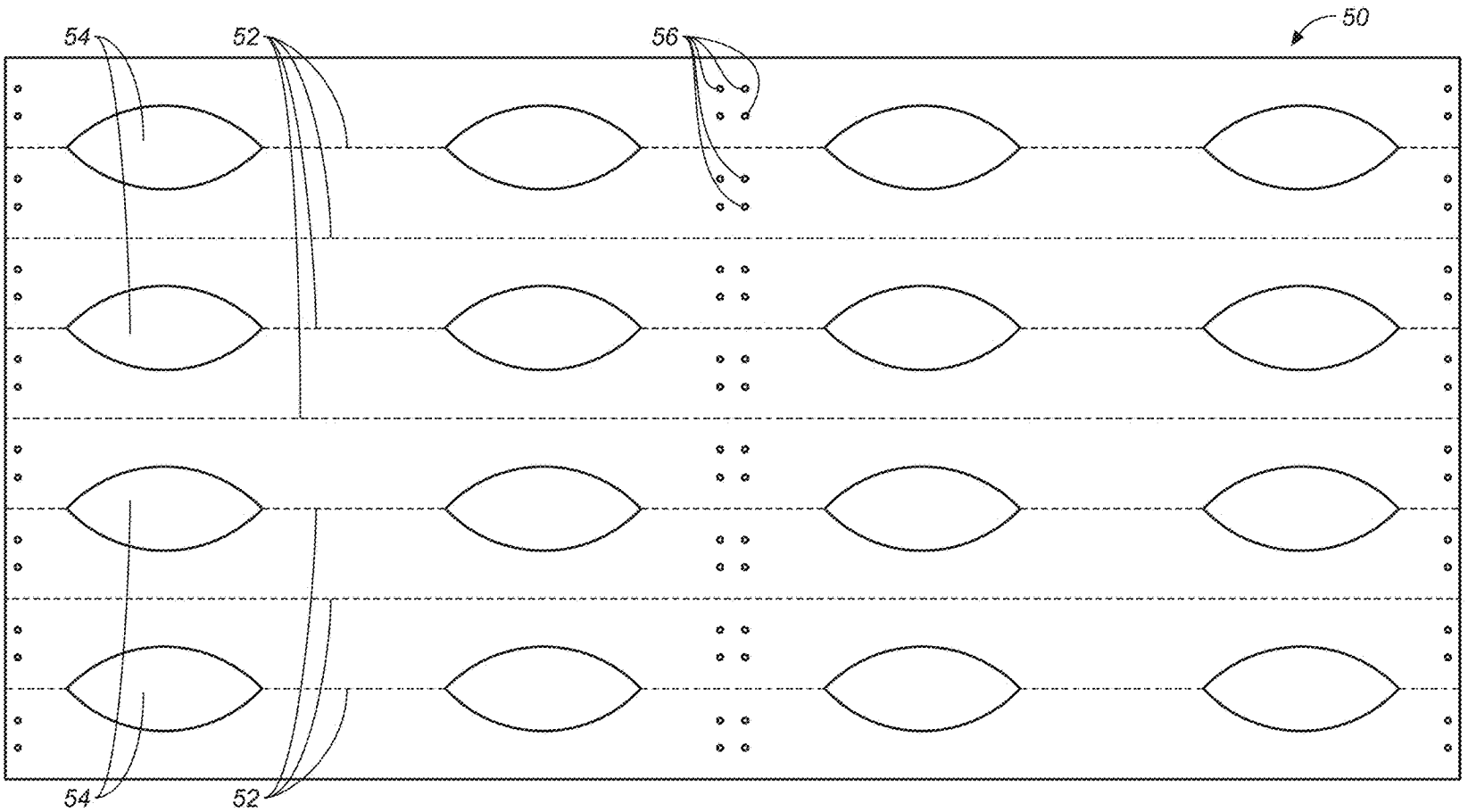
FIG. 4 is a top plan view of a panel of sheet metal showing the football-shaped cutouts which, when the side rails are cut long the dashed cut lines, will provide the arcuate depressions in the side rails for barrel support.

FIG. 4 shows a sheet metal panel 50 partially processed during manufacture of the ground-level rack elements. In this view, the sheet metal panel is shown marked along dotted cut lines 52 for cutting with a laser, water jet, bench (lever) shear, guillotine (squaring or power shear), etc. A plurality of football-shaped holes (i.e., prolate spherioid in longitudinal cross section) 54 have already been cut from the panel using, for instance, a laser or water jet, and bolt holes 56 have been punched or drilled. After the football holes are cut and the bolt holes drilled, the panel is cut along the cut lines 52 and then upper and lower flanges (26, 24, respectively, in FIGS. 1-2B) are bent using a press brake or, more preferably, a universal bending machine.

Connecting panels 16, 18, 20 are formed from a separate raw sheet of sheet metal, and then drilled and bent similarly.

FIGS. 5-7B show another embodiment 60 of the inventive rack, this embodiment adapted for stacking at either the ground level or at levels above ground level, including atop a row of barrels. Thus, when a ground level rack 10 is disposed on a cellar floor and a number of barrels WB are placed on the ground level rack, the stackable (upper) rack 60 may be placed atop the barrels on the ground level rack.

The stackable rack 60 includes first and second side rails 62, 62 joined at their ends 62*a*/62*b* and 64*a*/64*b*, respectively, by first and second connecting end panels 66, 68, and a medial connecting panel 70. The side rails are identical to one another, as are the connecting panels.

Figure 5:
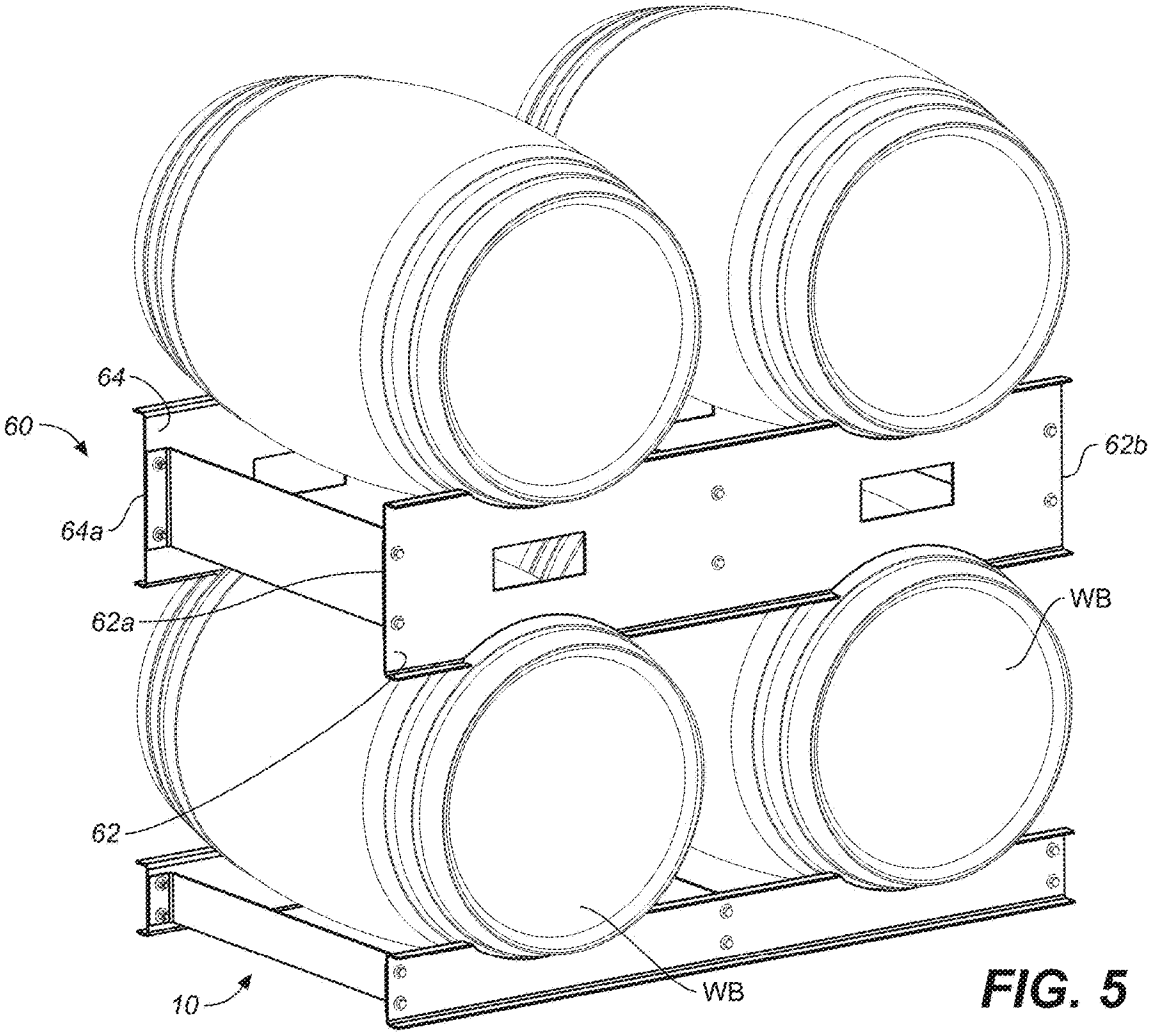
FIG. 5 shows the ground level configuration of the inventive rack holding two wine barrels and a stacked layer of the inventive rack atop the lowest level of barrels and upon which is a second row of barrels.
Figure 6A:
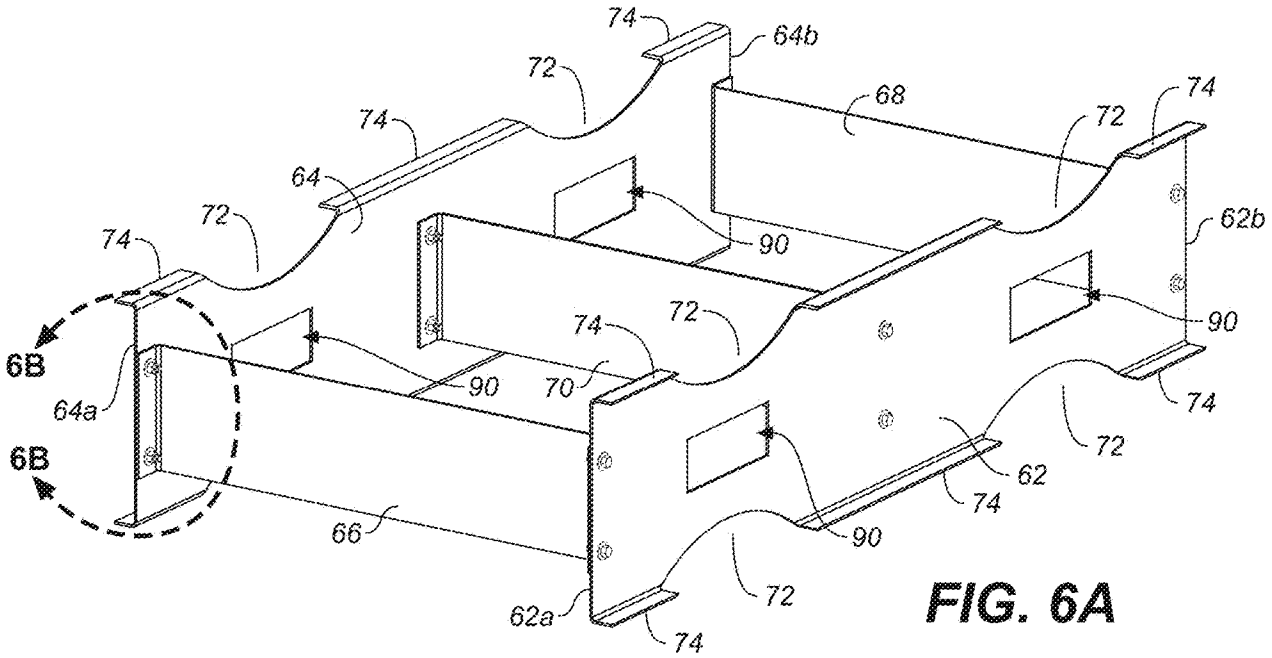
FIG. 6A is an upper front left front perspective view showing the stacked configuration.
Figure 6B:
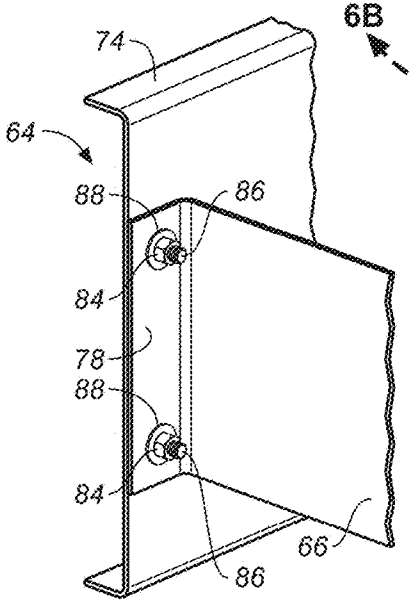
FIG. 6B is an upper left front perspective view showing details of the connection between a side rail and a connecting panel.
Figure 7A:
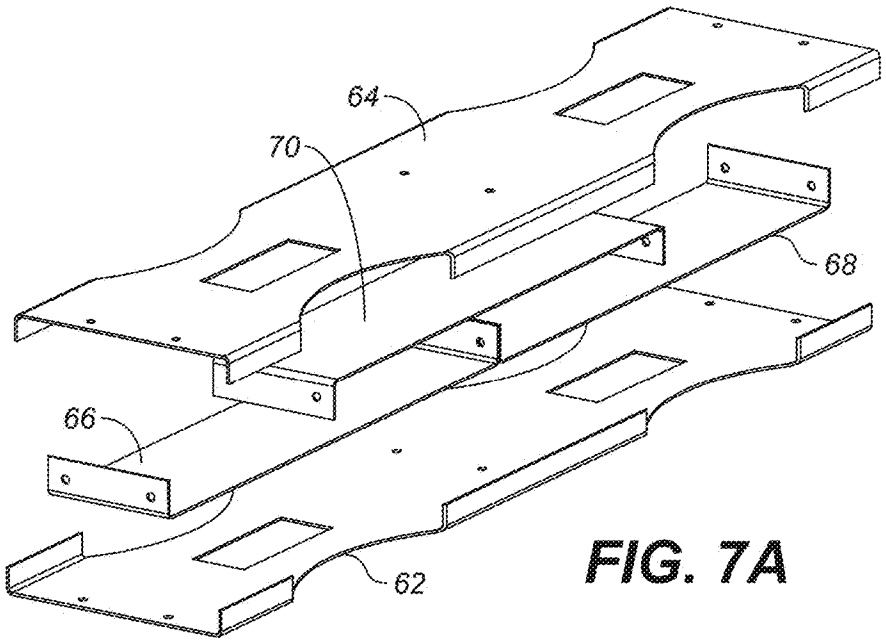
FIG. 7A is an upper perspective view showing the stacked configuration disassemble, the nuts and bolts removed, and the side rails and connecting panels positioned for nesting in a compact packaged configuration for storage and transportation.
Figure 7B:
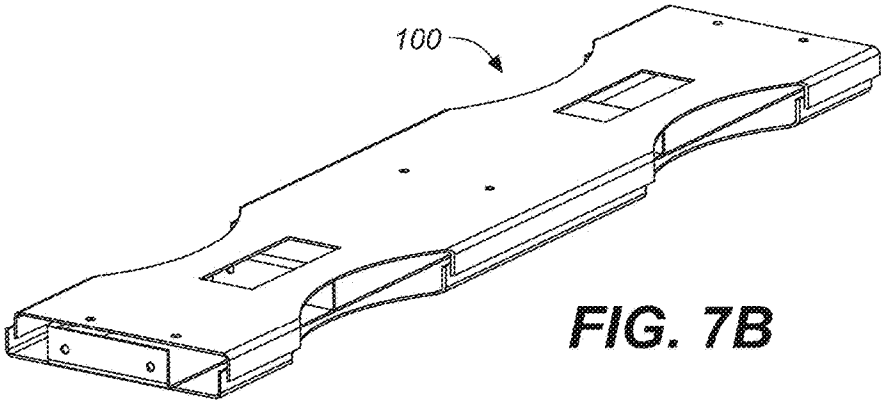
FIG. 7B shows the elements of the stacked configuration in a compact nested package for storage and transportation.

Each stackable side rail 62/64 includes a plurality of arcuate cut outs 72, each suitable for supporting or cradling a wine barrel when paired with a cutout on the opposing side rail, as shown in FIG. 5, and also suited for stacking atop barrels positioned below. Unlike the ground level embodiment, the stackable rails include arcuate cutouts on each longitudinal edge of the rail. Thus, the rails may be rotatated about a longitudinal axis, and with the flange or bend 74 facing outward, the rail may be flipped over and used in an inverted orientation (as can the assembled rack).

As with the first embodiment, U-shaped connecting panels 66/68/70 again include legs 78 and through holes 80 that align with through holes 82 in the side rails for connection with nuts 84, bolts 86, and washers 88.

Forklift holes 90 may be provided in the side rails.

The rack elements are each preferably formed from stainless steel, and more preferably with 300 series austenitic stainless steel, though any of a number of kinds of stainless steel and aluminum panel kinds may be employed to provide a rack with sufficient structural integrity and corrosion resistance to handle the heavy loads borne by racks in which barrels are stacked 4 or more levels high in slightly acid and humid cellar environments.

The stackable rack is also capable of compact storage in nestable packs 100, thus making it fit for large shipping unassembled in large numbers so as to be able to meet the needs of an end user at low cost and in quick order.

In another embodiment of the present invention, shown in FIGS. 8-11, the ground level configuration 200, includes side rails 202, 204 joined near or at their ends, respectively 206*a*/206*b* and 208*a*/208*b* (208*b* being concealed in FIG. 8), by first and second laterally disposed cross members 210, 212, and at least one (preferably several) medial cross support(s) 214. The side rails are identical to one another, as are the cross members.

Figure 8:
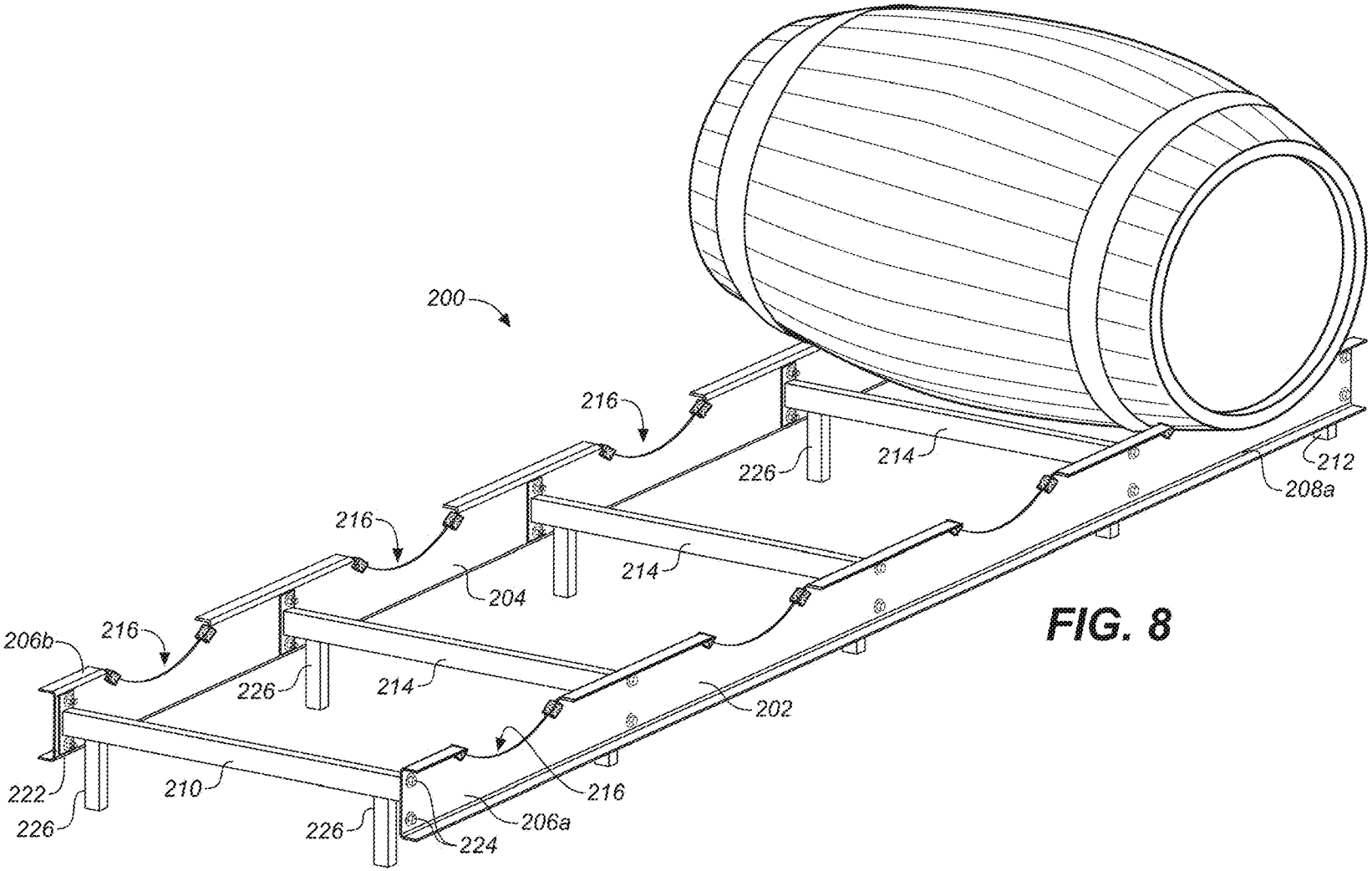
FIG. 8 is an upper front left perspective view of the ground level configuration of an embodiment of the wine barrel rack of the present invention, shown supporting a single wine barrel.
Figure 9:
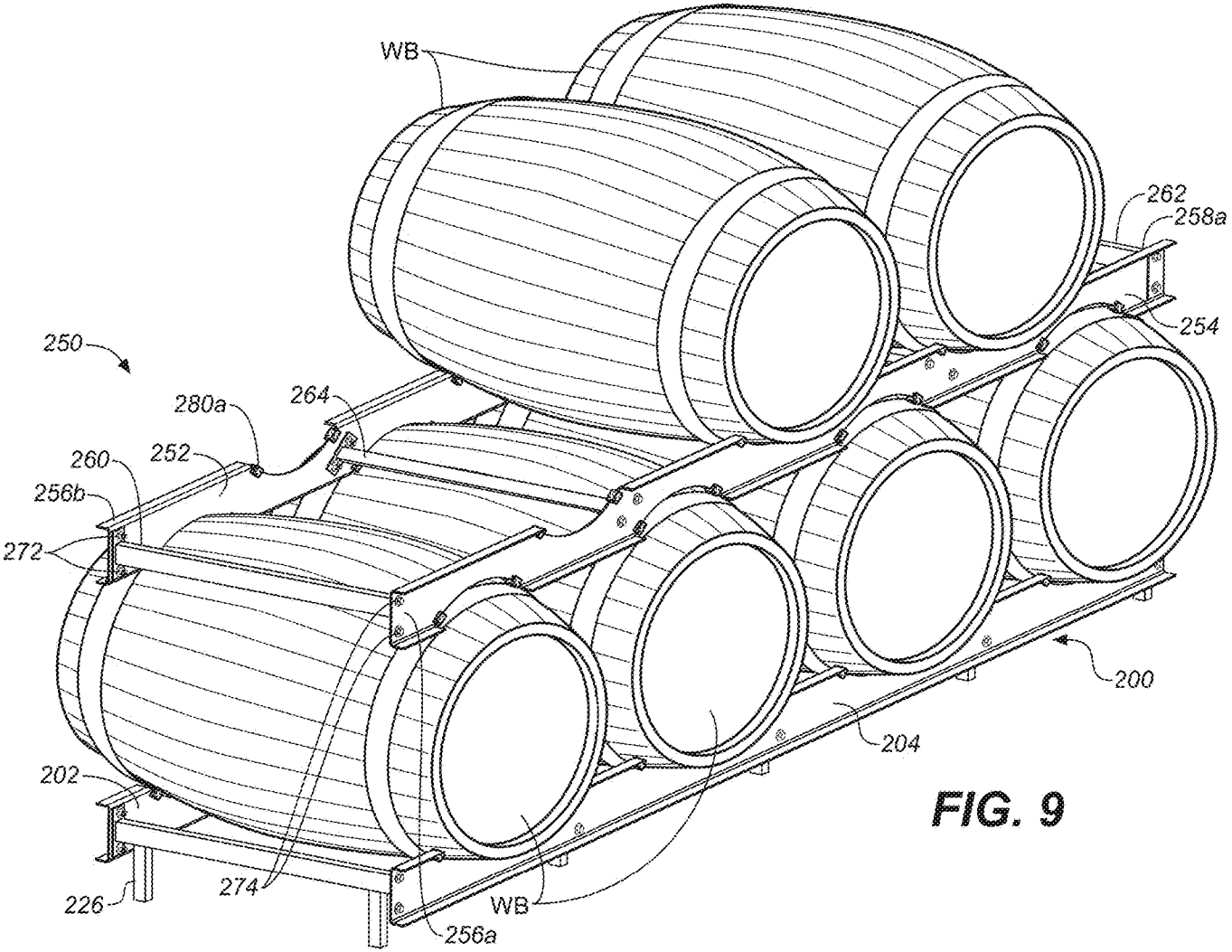
FIG. 9 shows the ground level configuration of the inventive rack holding four wine barrels and a stacked layer of the inventive rack atop the lowest level of barrels and upon which is a second row of barrels, partially filled.
Figure 10A:
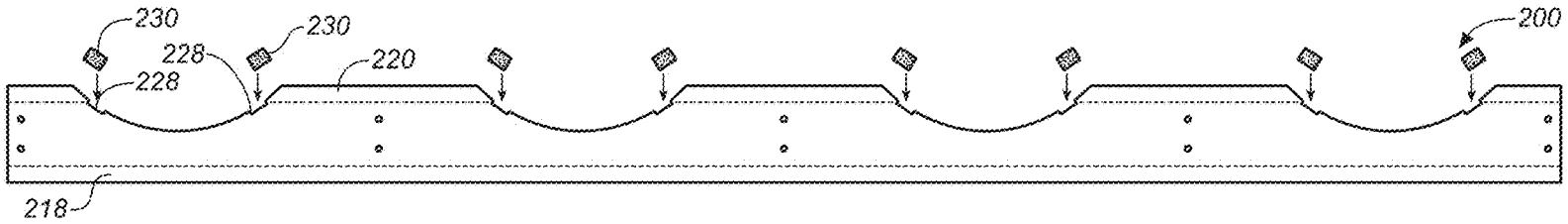
FIG. 10A is a side view in elevation showing a sheet metal side rail after cutting but before bending, wherein the bend lines are shown with dashes.
Figure 10B:
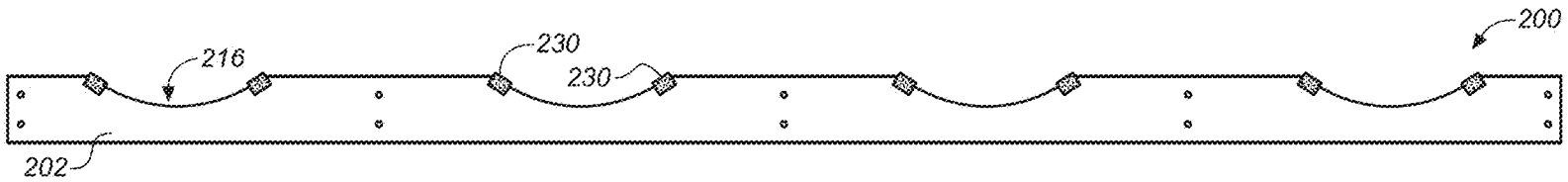
FIG. 10B is the same view showing the side rail after the upper and lower bends have been made.
Figure 10C:
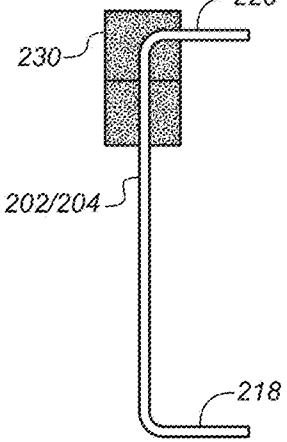
FIG. 10C is an end view in elevation of the side rails.

Thus, it is seen that each ground level side rail 202/204 includes a plurality of arcuate cut outs 216, each suitable for supporting or cradling a wine barrel when paired with a cutout on the opposing side rail, as shown in FIGS. 8-9.

Each side rail further includes an outwardly directed lower bend or flange 218, and an outwardly directed upper bend or flange 220, continuous but for interruptions at the arcuate cutouts, and thereby comprising a formed sheet.

The end cross members 210/212 and medial cross members 214 are each fabricated from square or rectangular tube (steel, aluminum, alloys, etc.) with an integral and/or welded flange 222 and through holes that align with through holes in the side rails for connection with nuts and bolts 224, respectively, the holes concealed by the nut/bolts assemblies, but evident in the views. The cross members for the ground level configuration further include legs 226 to elevate the entire rack off the ground and provide clearance for water and wine to run freely out from under the assembly and for the forks of a forklift to fit under easily for easy and rapid movement of entire racks within a production facility.

This embodiment of the wine barrel rack of the present invention includes an enhanced cutout having notches 228 onto which chocks 230 with slots are disposed so as to provide support and cushioning in the arcuate cradle formed by the cutouts 216. The chocks are fabricated from a food grade resilient material, such as silicone or other suitable synthetic rubber product, so as to minimize any chance that the assembly will harbor microorganisms that might infect and destroy the beverage contained in the barrels.

Figure 11:
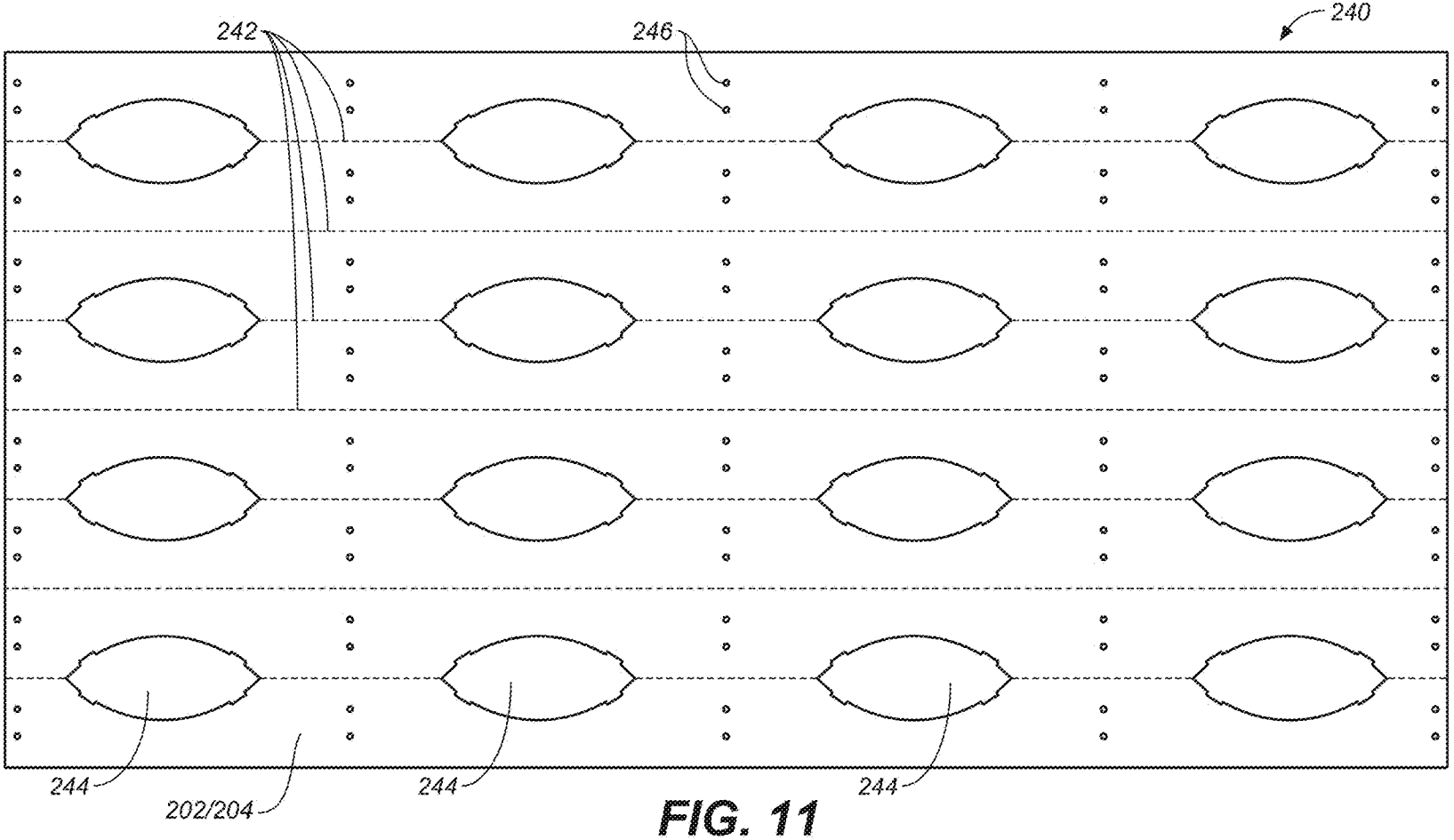
FIG. 11 is a top plan view of a panel of sheet metal showing the modified football-shaped cutouts which, when the side rails are cut long the dashed cut lines, will provide the arcuate depressions in the side rails for barrel support in an embodiment of the present invention.
Figure 12A:
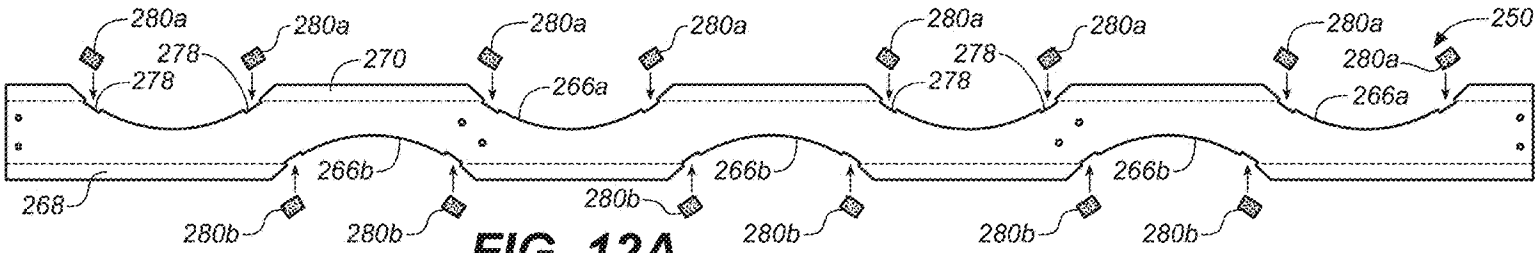
FIG. 12A is a side view in elevation showing in another embodiment a sheet metal side rail of the upper (stackable) rack side rail after cutting but before bending, wherein the bend lines are shown with dashes.
Figure 12B:
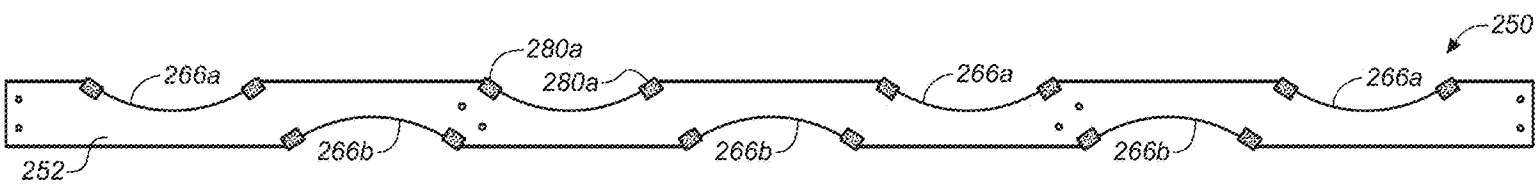
FIG. 12B is the same view showing the side rail after the upper and lower bends have been made.
Figure 12C:
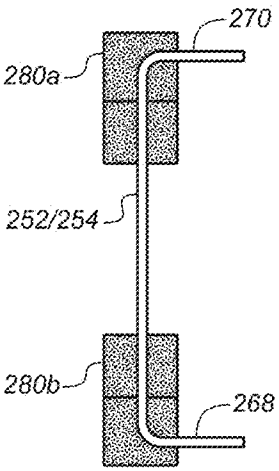
FIG. 12C is an end view in elevation of the upper (stackable) rack side rails.

FIG. 11 shows a sheet metal panel 240 partially processed during manufacture of the ground-level rack elements. In this view, the sheet metal panel is shown marked along dotted cut lines 242 for cutting with a laser, water jet, bench (lever) shear, guillotine (squaring or power shear), etc. A plurality of football-shaped holes 244 have already been cut from the panel using a laser or water jet, and bolt holes 246 have been punched or drilled. After the football holes are cut and the bolt holes drilled, the panel is cut along the cut lines and then upper and lower flanges (218, 220, respectively in FIGS. 8, 10A & 10C) are bent using a press brake or, more preferably, a universal bending machine.

Cross members 210, 212, 214 are formed from separate metal tubes and then drilled and provided with flanges.

FIG. 9 shows an upper (stackable) rack configuration 250 for use with the above described lower rack configuration. This upper rack configuration is adapted for stacking at levels above ground level, including atop a row of barrels. Thus, when the ground level rack 200 (FIG. 8) is disposed on a cellar floor and a number of barrels WB are placed on the ground level rack, the stackable rack 250 may be placed atop the barrels ground level barrels.

The upper (stackable) rack 250 is configured substantially identically to the ground level configuration with a few notable exceptions, clearly seen in FIG. 9, and better appreciated by reference to FIGS. 12A-14, where it is seen that the upper (stackable) rack 250 includes side rails 252, 254 joined near or at their ends, respectively 256*a*/256*b* and 258*a*/258*b* (258*b* being concealed in FIG. 9), by first and second cross members 260, 262, and at least one (preferably several) medial cross support(s) 264. Notes should be taken that medial cross members 264 are secured at an angle such that the sides and top portions of the cross members are oriented at an angle generally coincident with the curved sides of a wine barrel. The side rails are identical to one another, as are the cross members.

Thus, it is seen that in this embodiment each upper rack side rail 252/254 includes a plurality of upper and lower arcuate cut outs 266*a* and 266*b*, respectively, the upper arcuate cut outs adapted for supporting or cradling a wine barrel and bearing its weight, and the lower cut outs 266*b* adapted for placement over a wine barrel. The upper and lower cutouts are arranged in a staggered pattern, such that the lower cutouts re disposed under and generally centered between two adjoining upper cutouts.

Each side rail further includes an outwardly directed lower bend or flange 268, and an outwardly directed upper bend or flange 270, continuous but for interruptions at the arcuate cutouts, and thereby comprising a formed sheet.

The end cross members 260/262 and medial cross members 264 may be fabricated from square or rectangular tube (steel, aluminum, alloys, etc.) with an integral and/or welded flange 272 and through holes that align with through holes in the side rails for connection with nuts and bolts 274, respectively, the holes concealed by the nut/bolts assemblies, but evident in the views. The cross members for the upper rack configuration do not include legs to elevate the rack off the ground, as clearance for water and wine, for the forks of a forklift, and the like, is inherent in the elevated disposition of the rack when placed atop a wine barrel.

This embodiment of the wine barrel rack of the present invention also includes the enhanced cutout having notches 278 onto which upper chocks 280*a* and lower chocks 280*b*, each with slots, are disposed. Again, these provide support and cushioning in the arcuate cradle formed by the cutouts 266*a*/266*b*.

Figure 13:
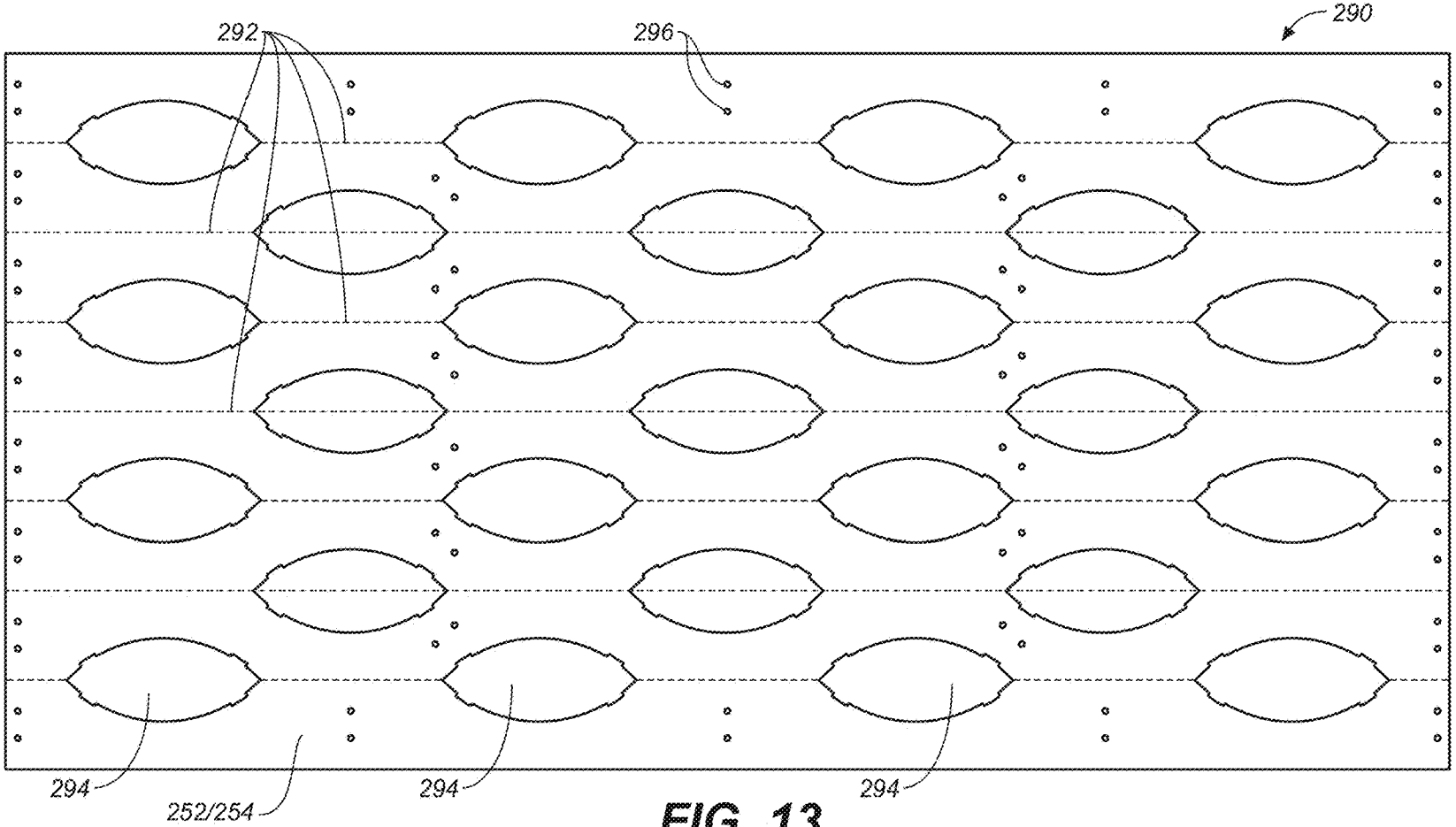
FIG. 13 is a top plan view of a panel of sheet metal showing the modified and staggered football-shaped cutouts for the embodiment shown in FIGS. 9, and FIGS. 12A-12C, which, when the side rails are cut long the dashed cut lines, will provide the arcuate depressions in the side rails for barrel support in this embodiment of the present invention.

FIG. 13 shows a sheet metal panel 290 partially processed during manufacture of the ground-level rack elements. In this view, the sheet metal panel is shown marked along dotted cut lines 292 for cutting. Football-shaped holes 294 for the enhanced cutouts have already been cut from the panel using a laser or water jet, and bolt holes 296 have been punched or drilled. After the football holes are cut and the bolt holes drilled, the panel is cut along the cut lines and then upper and lower flanges (268, 270, respectively in FIGS. 9, 12A & 12C) are bent.

Cross members 260, 262, and 264 are formed from separate metal tubes and then drilled and provided with flanges.

Figure 14:
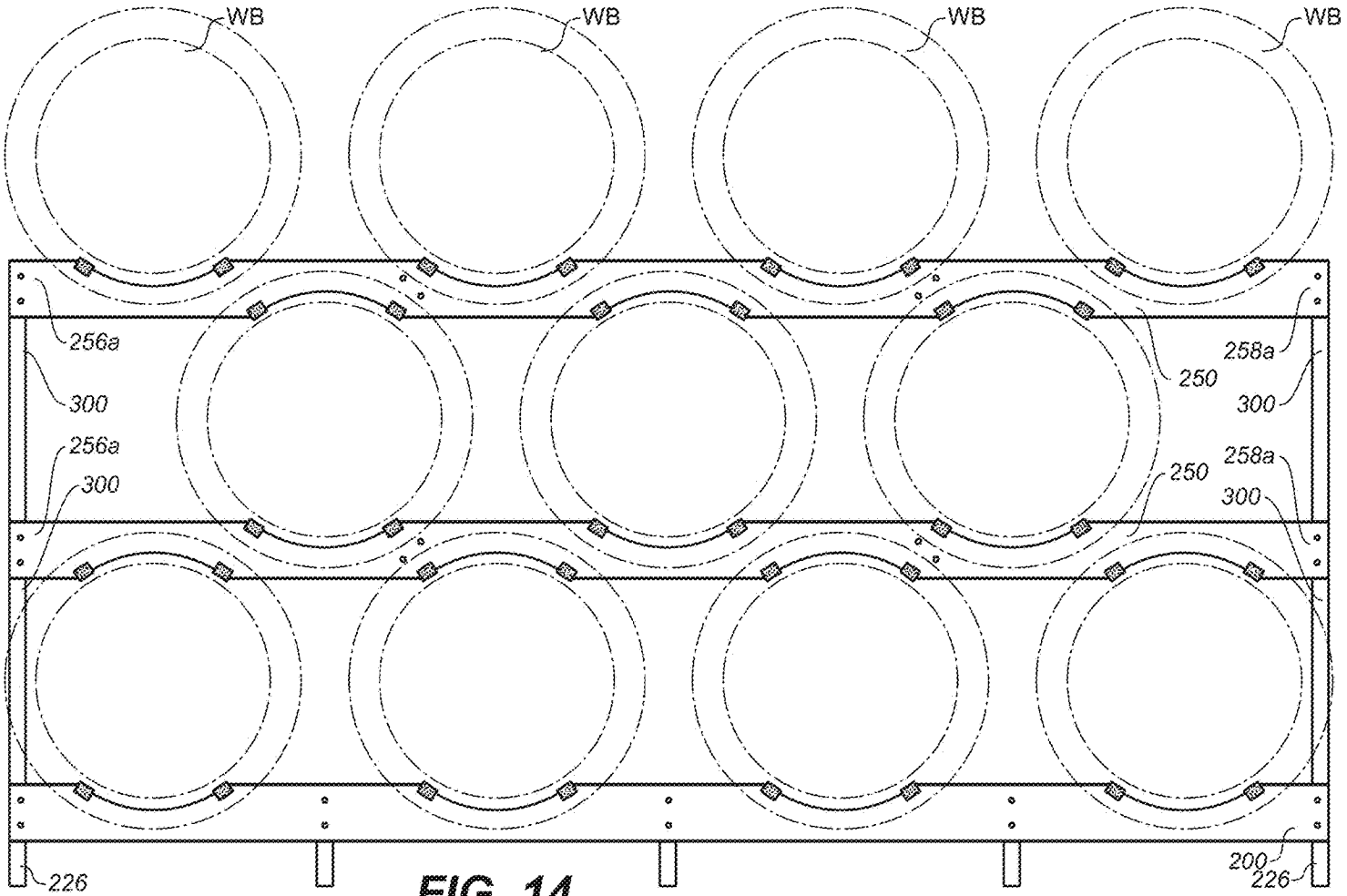
FIG. 14 is a side view in elevation showing the ground level configuration and upper (stackable) rack configuration in use, combined so as to enable a stacked and staggered arrangement of barrels as viewed from the side of the rack (corresponding to the end of the barrels)

FIG. 14 shows a three-level stack including the ground level configuration and two upper rack configurations as might be found in a wine barrel room or wine cave. This view features the staggered arrangement of barrels (as viewed from the side or barrel end view of the rack), which facilitates access to the bung B at the apex of the barrel. This view also shows how optional vertical supports 300 may be installed at the ends 256*a*/256*b*, and 258/258*b* of the side rails to provide further support and stability to the rack assembly.

Figure 15:
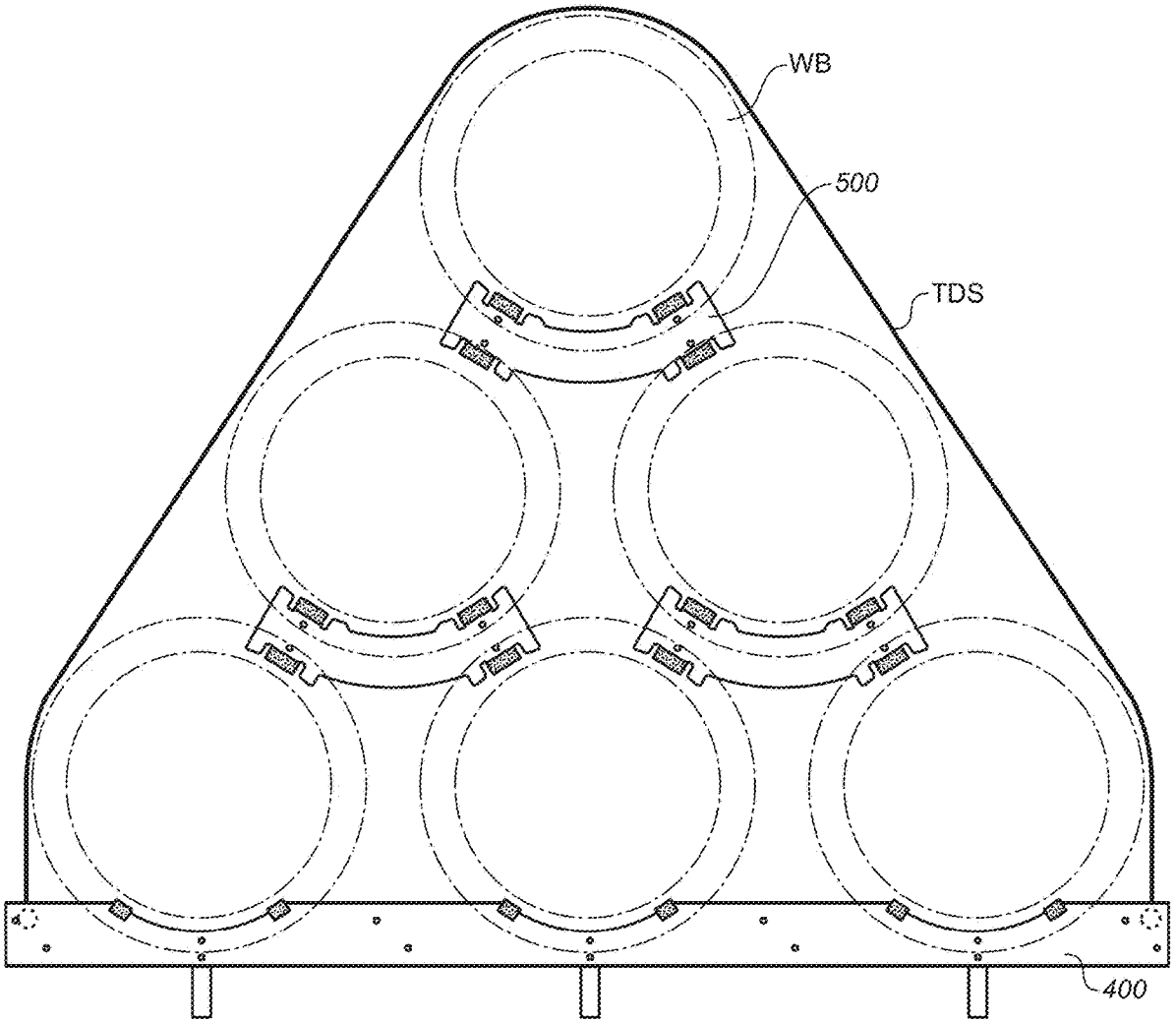
FIG. 15 is a schematic side view in elevation showing wine barrels stacked in a pyramidal configuration and further stabilized seismic strap using another embodiment of the inventive barrel rack.
Figure 16:
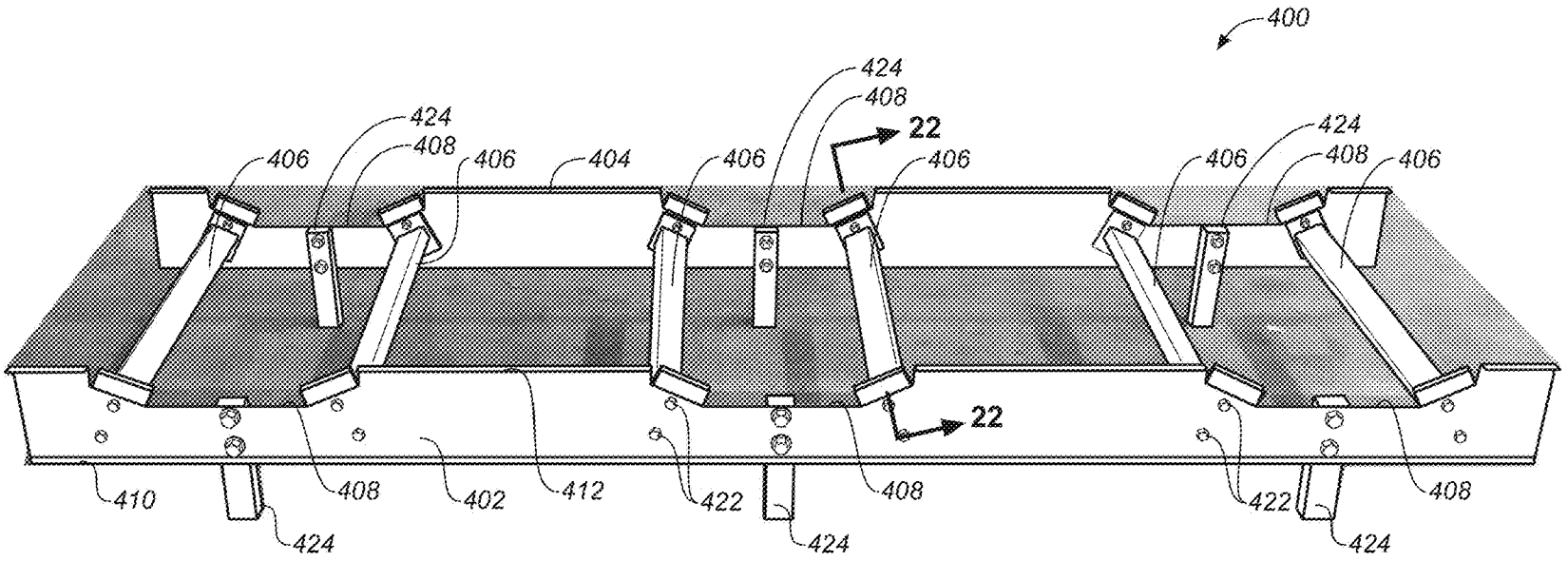
FIG. 16 is an upper perspective view showing the ground level configuration for the barrel rack system shown in FIG. 15.

In further embodiments of the present invention, shown in FIGS. 15-16, the ground level configuration 400, includes side rails 402, 404 joined by a plurality of identical cross members 406. As in the above-described embodiments, the side rails are identical to one another, as are the cross members. Thus, it is seen that each ground level side rail includes a plurality of cut outs 408, in opposing paired relationships, when the side rails are joined by the cross members, with the cutouts sized and shaped to accommodate a portion of a bottom of a wine barrel, as shown in FIG. 15. The cutouts may be arcuate in shape, though they need not be.

Each side rail also further includes an outwardly directed lower bend or flange 410, and an outwardly directed upper bend or flange 412, continuous but for interruptions at the cutouts, and thereby comprising a formed sheet.

The cross members 406 for use in this embodiment are each fabricated from square or rectangular tube 414 with an integral and/or welded bolting plate or flange 416 and through holes 418 that align with through holes in the side rails 420 for connection with nuts and bolts 422. Solid steel or aluminum blocks are cut to accommodate the flange and panel of the side rail and to bolt onto the side rails and thereby to act as legs 424 that elevate the side rail slightly above ground level, again, providing clearance for water and wine to run freely out from under the assembly and for the forks of a forklift to fit under for easy and rapid movement of loaded racks.

Figure 21:
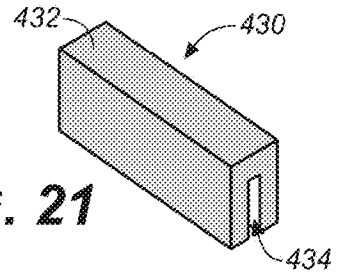
FIG. 21 is an upper perspective view of an embodiment of a slotted rubber chock.
Figure 21A:
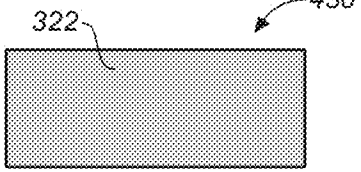
FIG. 21A is a side view in elevation thereof.
Figure 21B:
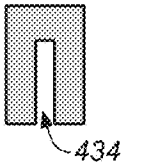
FIG. 21B is an end view in elevation thereof.
Figure 21C:
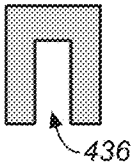
FIG. 21C is an end view of a slotted rubber chock adapted for use with the cross-member of FIGS. 20-20A.
Figure 22:
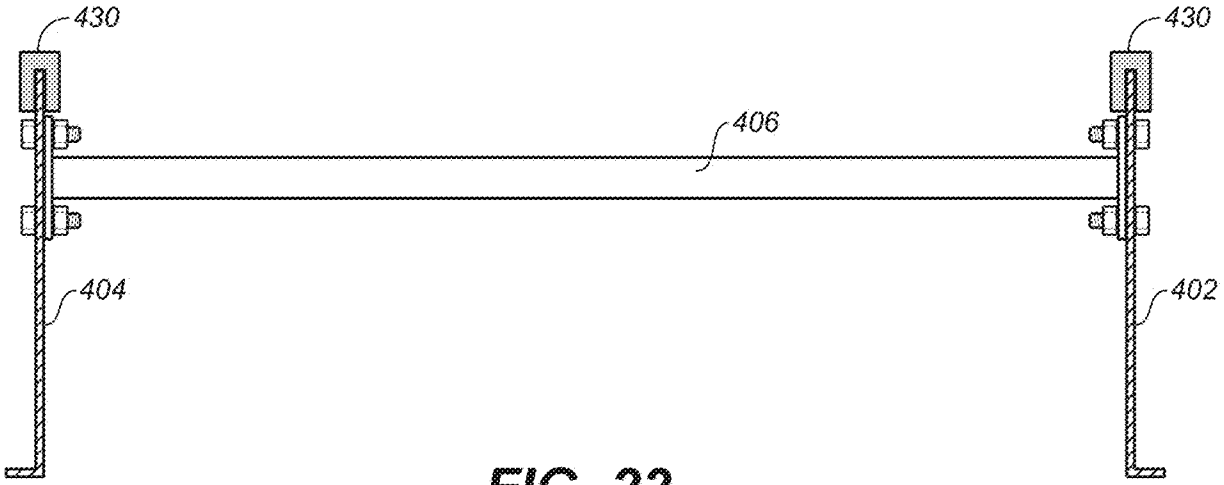
FIG. 22 is a cross-sectional end view in elevation taken along section line 20-20 of FIG. 16.
Figure 22C:
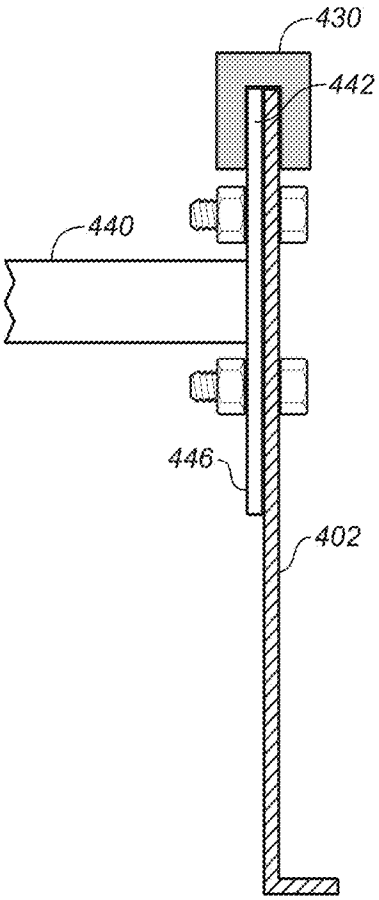
FIG. 22C is a detailed cross-sectional end view in elevation of an alternative embodiment using both the bolting plate of a cross-member and a wedge plate tongue for mounting a rubber chock.

As indicated above, the side rail cutouts may be any of a number of shapes, including arcuate (as in an earlier embodiment) or more polygonal in side view. In a preferred embodiment, the region of the side rail cutout may include inwardly angled mounting tongues 426 having an upper edge 427 and proximate an outer edge 428. A slotted food grade resilient mounting pad or chock 430 is placed on the tongue. Moreover, the tongue is spaced apart slightly from the cutout outer edge so as to allow some compression of the chock when under load from a barrel. From the views it will be seen that in an embodiment, the edge of the bolting plate 416 may be oriented and generally aligned with the tongue when the cross member bolt holes 418 are brought into alignment with the side rail bolt holes 420. The chocks comprise a food grade rubber, synthetic rubber, or polymeric block 432 with a slot 434 for placement over the tongue upper edge 427 or the bolting plate or a combination of the tongue and bolting plate (see further at FIGS. 21-21C). A wider slot 436 may be provided when the chock is to be disposed over a bolting plate and wedge plate tongue when those features are approximated at their sides in two metal plate layers, as shown in FIG. 22C.

As can be seen by reference to FIGS. 15-16, the ground level side rails are assembled in modular units with simple nuts-and-bolts couplings of the structural elements. When motorized drills and sockets are utilized, full assembly of each unit can be accomplished in a matter of only a few minutes. FIG. 15 shows the ground level assembly standing alone and the wine barrels stacked upon the assembly in a pyramidal scheme. Tie down straps TDS can be employed to provide enhanced stability in seismically active areas, such as California, Oregon, Chile, Italy, Greece, Japan, Mexico, and New Zealand. In more quiescent areas, staggered stacking at higher levels and on ganged ground level assemblies can be achieved (FIG. 15A).

Figure 15A:
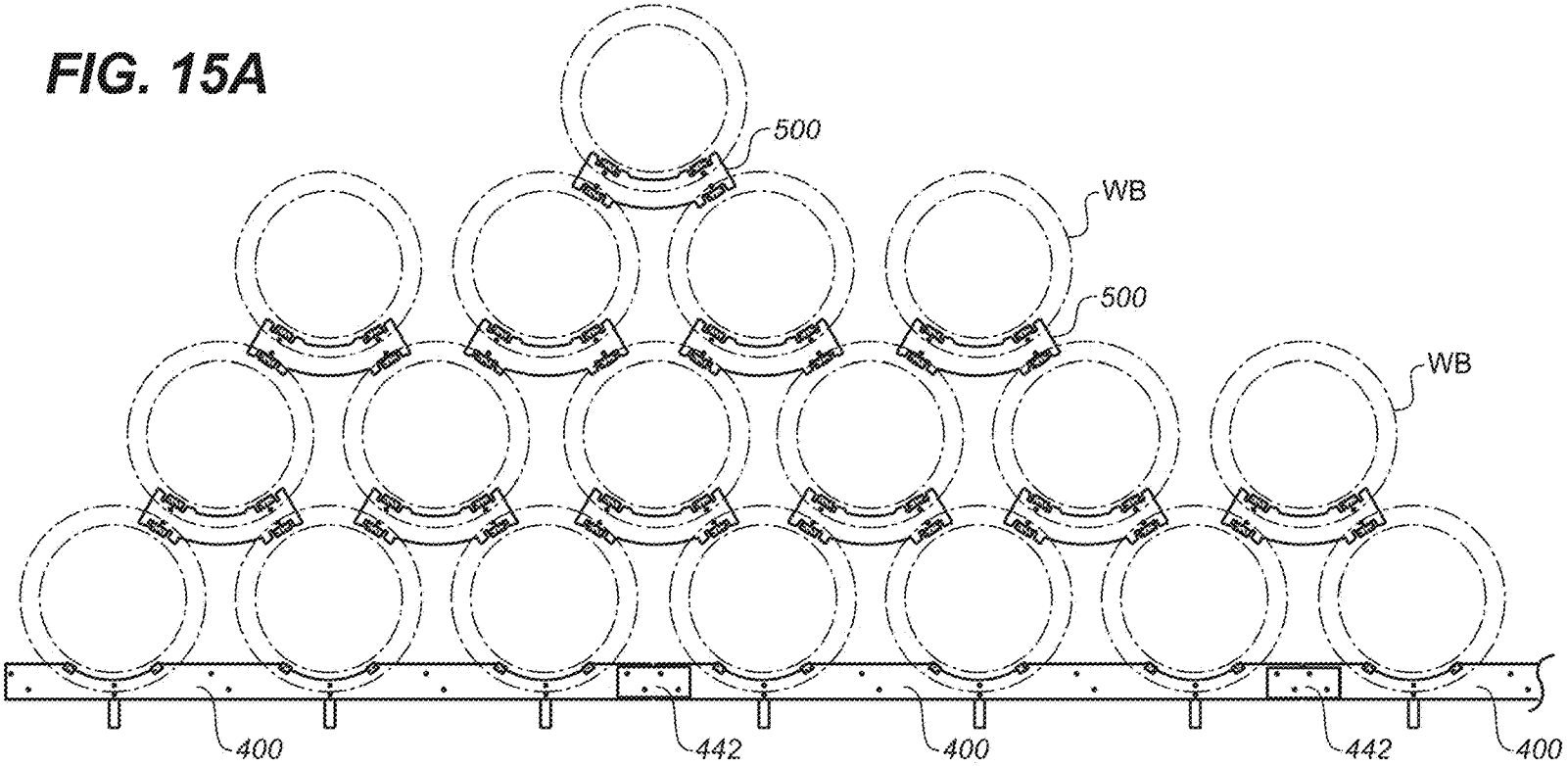
FIG. 15A is a schematic side view in elevation showing the same embodiment with ground level rail ganged assemblies and a non-pyramidal barrel stacking scheme.

Thus, and still referring to FIG. 15A, units can be joined or ganged in aligned and contiguous end-to-end groups by joining the ends 440 of the rails using a connecting panel 442. Thus, barrels may be stacked in the staggered stacking configuration shown in FIG. 15 not only over the middle portions of the assembled units 400, but carried over onto and above the joined end portion of coupled units.

Figure 17:
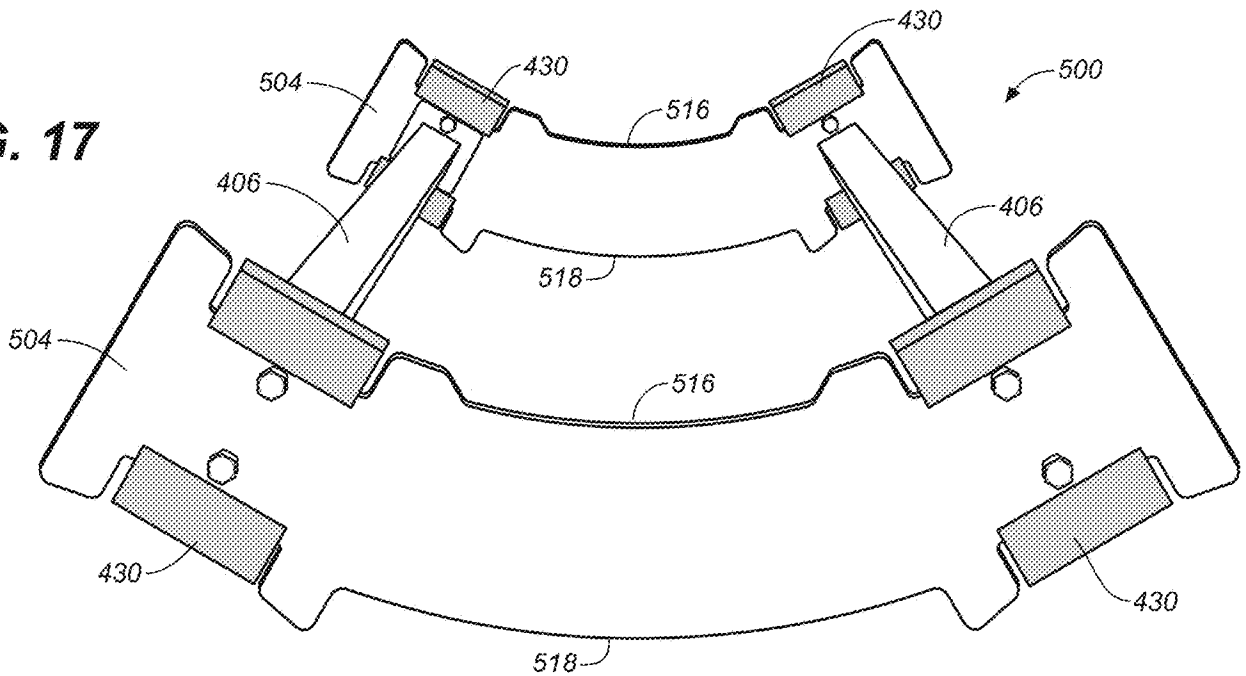
FIG. 17 is an upper front perspective view showing an embodiment of an arcuate cradle employed in the present invention.
Figure 18:
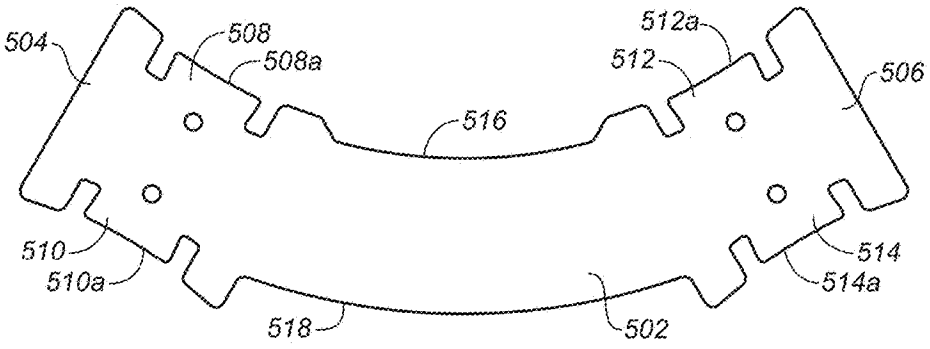
FIG. 18 is a side view in elevation of the arcuate side panel component of the arcuate cradle'
Figures 19, 19A, 19B, 19C, 20, 20A:
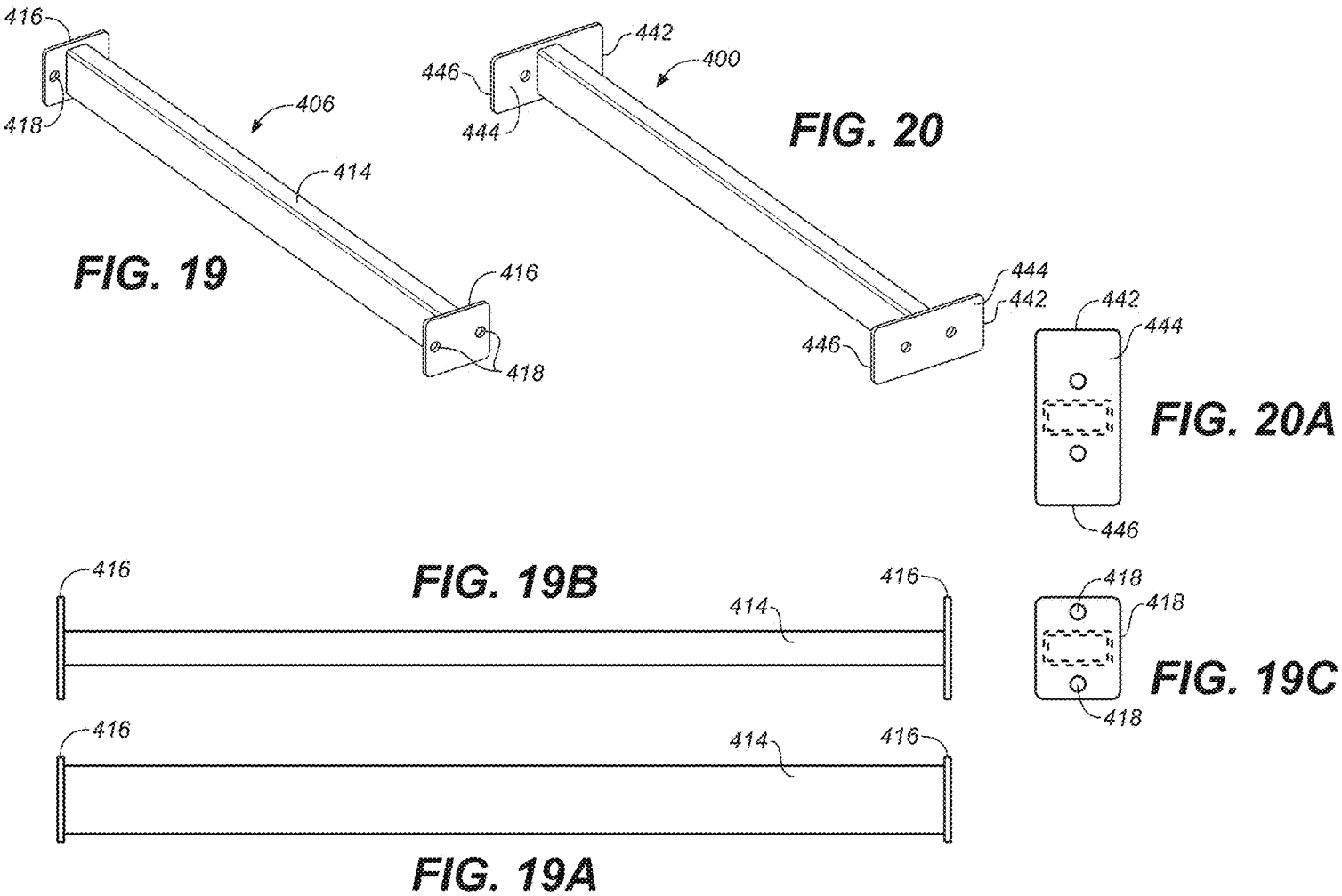
FIG. 19 is a perspective view showing an embodiment of a cross member that may be employed to couple front and rear arcuate side panels.
FIG. 19A is a side view in elevation thereof.
FIG. 19B is a top plan view in elevation thereof.
FIG. 19C is an end view thereof.
FIG. 20 is a perspective view showing another embodiment of a cross member that may be employed to couple front and rear arcuate side panels.
FIG. 20A is an end view thereof.

While many, if not most, wine producers may use barrels of identical size and construction for wine storage, barrels are handmade and inherently imperfectly sized. Further, some winemakers may wish to experiment with different barrels from different coopers. The rigid rails systems of the above-described embodiments are not perfectly adapted for use on rows of barrels that include any barrel departing from the size of adjoining barrels. Thus, and referring now to FIGS. 17-18, in an embodiment, to further facilitate stacking in a staggered stacking configuration and for stacking differentially sized barrels, the upper (stackable) rack elements may be formed as discrete, single-barrel cradles 500, each adapted for supporting only a single barrel.

Each cradle 500 includes identical opposing substantially planar metal wedge plates 502 joined by cross members 406 identical to those employed in the ground rail assembly. In an embodiment the wedge plates comprise an elongate shape having mirror image first and second ends 504, 506 configured with upper and lower angled mounting tongues 508, 510, and 512, 514, respectively, at their ends, and each having an edge 508*a*, 510*a*, 512*a*, 514*a* generally in line with the respective upper edge 516 and lower edge 518 of the wedge plate. The mounting tongues may be defined by slots cut into the upper and lower edges of the wedge plate. The arcuate shape includes an upper edge radius slightly larger than the radius of a standard 60-gallon wine barrel or a 53-gallon whiskey barrel between the quarter hoop and head hoop circumferences. A resilient mounting chock 430 may be disposed on the edges of each tongue so as to cushion barrels above and below (see FIG. 15). The wedge plates may be fabricated from any of a number of suitable metals, though stainless steel and aluminum are favored. Aluminum has natural corrosion resistance, but this may be enhanced with coatings, including those that simply stabilize aluminum oxide.

Figure 22B:
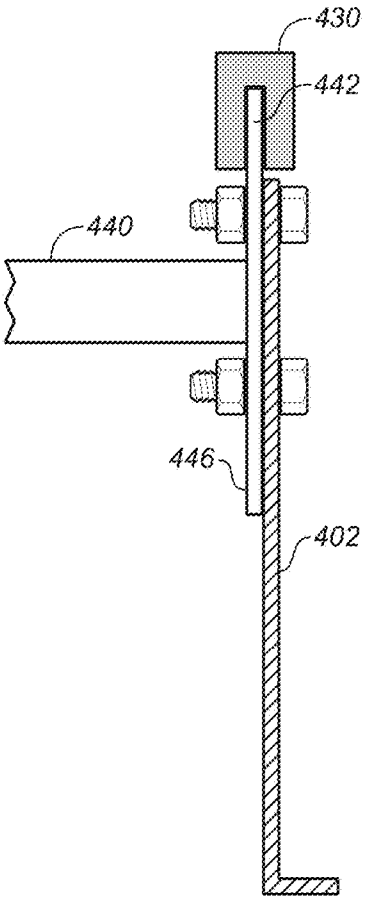
FIG. 22B is a detailed cross-sectional end view in elevation of an alternative embodiment using the bolting plate of a cross-member for mounting a rubber chock.
Figure 22A:
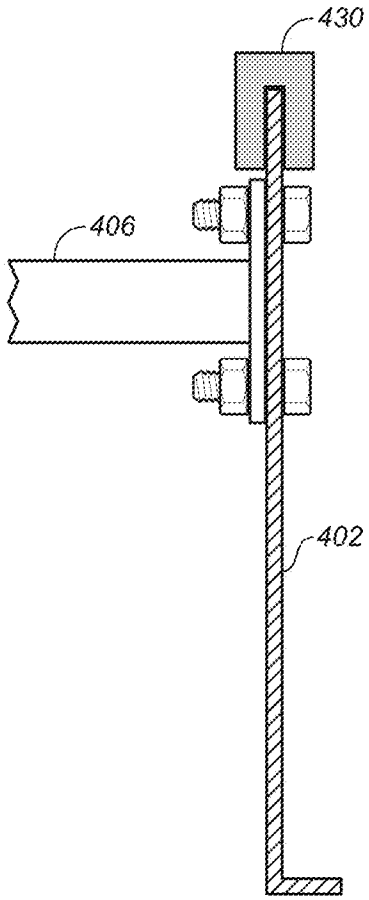
FIG. 22A is a detailed view thereof.

In an alternative embodiment of the cross member 440, an upper side 442 of the bolting plate 444 may be elongated so as to obviate the need for a tongue in either the ground level side rails or the wedge plates, such that the elongated upper side 442 functions as the barrel support structure (see FIG. 22B). Alternatively, an elongate upper side may supplement and reinforce the side rail and wedge plate tongues by providing another layer of steel at the critical support point (see FIG. 22C). In this embodiment, the bolt hole orientation is again diagonal or otherwise oriented in combination so as to align the bolt plate upper edge 446 with the tongue upper edge 508*a*, 510*a*.

In still another embodiment, cross member 440 may include a bolting plate or flange having both an elongated upper side 442 and an elongated lower side 446, thereby obviating the need for a tongue on either the upper side or the lower side of the wedge plate.

Those with skill will appreciate that after transport in a nested configuration, the barrel rack of the present invention may be assembled using welds rather than using a nut-and-bolt assembly. The advantage of a potential rapid disassembly or reconfiguration is lost in such a case, but there is the concomitant advantage gained through the elimination of self-loosening nuts and bolt connections.

As will be appreciated from reference again to FIGS. 1 and 9, when the upper level rack member includes side rails that span across three or more lower barrels, any differential in the outer circumference of the lower barrels at the points of support will introduce a tilt in the rails. Accordingly, an advantage residing in an arrangement with separated upper cradles is to provide means to accommodate differentially sized barrels (with respect to circumference). Indeed, with such an arrangement, significant differences in barrel circumference can be accommodated.

Thus, it is seen that in embodiments, each upper cradle is adapted for resting on barrels in a lower course (whether ground level or above) and for supporting or cradling a wine barrel and bearing its weight. As with the embodiment using an upper rail configuration, the ground level rail and discrete cradle arrangement provides a staggered stacking pattern.

The above disclosure is sufficient to enable one of ordinary skill in the art to practice the invention, and provides the best mode of practicing the invention presently contemplated by the inventor. While there is provided herein a full and complete disclosure of the embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A wine barrel rack and support system, comprising:

a plurality of elongate cross-members having an elongate tubular portion with first and second ends, and cross-member flanges disposed on each of said first and second ends, at least one ground level rack assembly including first and second ground level side rails oriented generally parallel to one another, the ground level rack assembly configured to support a plurality of barrels; at least two of said cross-members being disposed between and connecting said first and second ground level side rails;

at least two upper level single-barrel cradles, each including first and second wedge plates affixed to at least two of the cross-members at said cross-member flanges, each of the wedge plates having an upper edge and a lower edge, the upper edge including an upper mounting tongue defined between two slots cut into the upper edge, and the lower edge including a lower mounting tongue defined between two slots cut into the lower edge; and resilient mounting chocks coupled to the upper mounting tongues and lower mounting tongues of the wedge plates;

wherein each of the first and second wedge plate comprise a wedge plate body having a first end and a second end, a first wedge body axis passing from the first end to the second end and a second wedge body axis perpendicular to the first axis;

wherein a first upper barrel contact surface and a second upper barrel contact surface project upward from an upper surface of the wedge plate body, the first upper barrel contact surface disposed adjacent the first end and the second upper barrel contact surface disposed adjacent the second end, a first end contact surface axis passing through the first upper barrel contact surface and a second end contact surface axis passing through the second upper barrel contact surface, and wherein a first lower barrel contact surface and a second lower barrel contact surface project downward from a lower surface of the wedge plate body opposite the upper surface, the first lower barrel contact surface disposed adjacent the first end and the second lower barrel contact surface disposed adjacent the second end, the first lower barrel contact surface being directed approximately opposite the first upper barrel contact surface along the first end contact surface axis, and the second lower barrel contact surface being directed approximately opposite the second upper barrel contact surface along the second end contact surface axis.

2. The wine barrel rack and support system of claim 1, wherein at least one of the upper mounting tongue and the lower mounting tongue is positioned adjacent a respective cross-member flange to form a mounting flange, and wherein at least one of the resilient mounting chocks are disposed on the mounting flange.

3. The wine barrel rack and support system of claim 1, wherein the resilient mounting chocks are disposed on the cross-member flanges.

4. The wine barrel rack and support system of claim 1, wherein the wedge plates are planar metal plates.

5. The wine barrel rack and support system of claim 1, wherein the wedge plates have a radius larger than that of a 60-gallon wine barrel as measured between the quarter hoop and head hoop circumferences of the barrel.

6. The wine barrel rack of claim 1, wherein the cross-member flanges are bolting plates affixed to the single-barrel cradles using nuts and bolts.

7. The wine barrel rack of claim 1, wherein the cross-member flanges are welded to the single-barrel cradles in the assembled configuration for supporting the plurality of wine barrels.

8. The wine barrel rack and support system of claim 7, wherein at least one of the upper mounting tongue and the lower mounting tongue is positioned adjacent a respective cross-member flange to form a mounting flange, and wherein at least one of the resilient mounting chocks are disposed on the mounting flange.

9. The wine barrel rack and support system of claim 7, wherein the resilient mounting chocks are disposed on the cross-member flanges.

10. A wedge plate for a barrel rack comprising:

a wedge plate body having a first end and a second end, a first wedge body axis passing from the first end to the second end and a second wedge body axis perpendicular to the first axis, the wedge plate body having an upper edge and a lower edge, the upper edge including an upper mounting tongue defined between two slots cut into the upper edge, and the lower edge including a lower mounting tongue defined between two slots cut into the lower edge, the upper mounting tongue and lower mounting tongue supporting a resilient mounting chock therealong;

a first upper barrel contact surface and a second upper barrel contact surface projecting upward from an upper surface of the wedge plate body, the first upper barrel contact surface disposed adjacent the first end and the second upper barrel contact surface disposed adjacent the second end, a first end contact surface axis passing through the first upper barrel contact surface and a second end contact surface axis passing through the second upper barrel contact surface;

a first lower barrel contact surface and a second lower barrel contact surface projecting downward from a lower surface of the wedge plate body opposite the upper surface, the first lower barrel contact surface disposed adjacent the first end and the second lower barrel contact surface disposed adjacent the second end, the first lower barrel contact surface being directed approximately opposite the first upper barrel contact surface along the first end contact surface axis, and the second lower barrel contact surface being directed approximately opposite the second upper barrel contact surface along the second end contact surface axis.

11. A wedge plate as in claim 10, wherein the wedge plate body has a substantially planar shape.

12. A wedge plate as in claim 10, further comprising a cross member extending between the wedge plate and a second wedge plate thereby forming a single barrel cradle, the single barrel cradle being configured to support a single upper tier barrel contacting the first upper barrel contact surface and the second upper barrel contact surface on each of the two wedge plates and being supported by two lower tier barrels, a first of the two lower tier barrels contacting the first lower barrel contact surface on each of the two wedge plates and a second of the two lower tier barrels contacting the second lower barrel contact surface on each of the two wedge plates.

* * * * *